US009339704B2

(12) United States Patent
Yontz et al.

(10) Patent No.: US 9,339,704 B2
(45) Date of Patent: May 17, 2016

(54) METHODS FOR SELECTING GOLF BALLS BASED ON ENVIRONMENTAL FACTORS

(75) Inventors: Nicholas Yontz, Portland, OR (US); Nicholas A. Leech, Aloha, OR (US)

(73) Assignee: Nike, Inc., Beaverton, OR (US)

( * ) Notice: Subject to any disclaimer, the term of this patent is extended or adjusted under 35 U.S.C. 154(b) by 925 days.

(21) Appl. No.: 13/435,258

(22) Filed: Mar. 30, 2012

(65) Prior Publication Data

US 2013/0260922 A1 Oct. 3, 2013

(51) Int. Cl.

| | |
|---|---|
| ***A63B 37/12*** | (2006.01) |
| ***A63B 57/00*** | (2015.01) |
| *A63B 37/00* | (2006.01) |
| *A63B 47/00* | (2006.01) |
| *A63B 69/36* | (2006.01) |

(52) U.S. Cl.

CPC ..... *A63B 57/00* (2013.01); *A63B 37/0003* (2013.01); *A63B 47/008* (2013.01); *A63B 2069/3605* (2013.01)

(58) Field of Classification Search

CPC ..... A63B 45/00
USPC ..... 473/409
See application file for complete search history.

(56) References Cited

U.S. PATENT DOCUMENTS

| | | | | |
|---|---|---|---|---|
| 4,063,259 | A | 12/1977 | Lynch et al. | |
| 4,375,887 | A | 3/1983 | Lynch et al. | |
| 5,332,226 | A * | 7/1994 | Kim | 473/384 |
| 6,086,487 | A | 7/2000 | Morgan et al. | |
| 6,192,323 | B1 | 2/2001 | Boehm | |
| 6,385,559 | B2 | 5/2002 | Boehm | |
| 6,490,542 | B2 | 12/2002 | Boehm | |
| 6,611,792 | B2 | 8/2003 | Boehm | |
| 6,658,371 | B2 | 12/2003 | Boehm et al. | |
| 6,672,978 | B1 | 1/2004 | Morgan et al. | |
| 6,742,385 | B2 | 6/2004 | Katayama | |
| 6,760,685 | B2 | 7/2004 | Boehm | |
| 7,811,182 | B2 | 10/2010 | Ligotti et al. | |
| 7,908,907 | B1 * | 3/2011 | Nelson et al. | 73/65.03 |
| 7,918,751 | B1 * | 4/2011 | Mayes | 473/409 |
| 2009/0017945 | A1 | 1/2009 | Tayama et al. | |
| 2011/0009215 | A1 | 1/2011 | Ichikawa et al. | |
| 2012/0150502 | A1 * | 6/2012 | Baek et al. | 703/2 |

* cited by examiner

*Primary Examiner* — Raeann Gorden
(74) *Attorney, Agent, or Firm* — Quinn Law Group, PLLC

(57) ABSTRACT

Methods for selecting golf balls based on environmental factors are provided. Such methods involve indicating a golfing environment and establishing one or more corresponding environmental factors. Such methods may include ascertaining one or more trajectory components that are dependent upon the environmental factors. One or more aspects of golf ball construction may pertinent to the environmental factors, or to the trajectory components, may then be determined. Upon identifying a plurality of golf balls and a selection criteria related to the golf ball construction aspects, a golf ball may be selected.

23 Claims, 22 Drawing Sheets

Carry Distance

| Ball | Orientation | at 1st elevation | at 2nd elevation | at 3rd elevation |
|---|---|---|---|---|
| 1 | pole | 286.0 | 300.4 | 307.6 |
| 2 | pole | 284.6 | 299.5 | 307.2 |
| 3 | pole | 285.4 | 301.0 | 309.6 |
| 1 | seam | 286.3 | 301.2 | 309.1 |
| 2 | seam | 287.2 | 301.2 | 308.2 |
| 3 | seam | 285.8 | 301.8 | 310.9 |

FIG. 27

METHODS FOR SELECTING GOLF BALLS BASED ON ENVIRONMENTAL FACTORS

BACKGROUND

Avid golfers are constantly mindful of products and practices that can improve their golf game. Golfers may seek out those articles of equipment that they conclude will be to their advantage to use on the golf course. For example, golfers may search for golf clubs having a comfortable fit or feel and that lend themselves to better golf swings. Similarly, golfers may search for golf balls that are comfortable to hit, and whose performance characteristics are suited to the golfer's skill level or style. Golfers may invest substantial time and energy in an effort to find equipment well suited to them.

At the same time, environmental factors may affect the performance of various golf balls. That is, one or more characteristics of a golfing environment may impact various characteristics of golf ball trajectories. Such environmental factors may include altitude, grass type, green speed, moisture content, wind speed, temperature, or visible landscape characteristics.

However, certain aspects of golf ball construction may have configurations that are better suited to one type of golfing environment than another. Moreover, some golf balls may have configurations of those aspects of golf ball construction that make them more suitable for a particular golfing environment than other golf balls.

Accordingly, there is a need to evaluate and select between various golf balls to assist in selecting a golf ball that may be best suited to a particular golfing environment.

SUMMARY

In one aspect, some methods for selecting a golf ball based on environmental factors comprise steps of indicating, establishing, determining, identifying, and selecting. In one step, these methods include indicating a golfing environment. In another step, these methods include establishing at least one environmental factor corresponding with the golfing environment. In another step, these methods include determining one or more golf ball construction aspects pertinent to the at least one environmental factor. In another step, these methods include identifying (a) a plurality of golf balls, each golf ball of the plurality of golf balls having a configuration of each of the one or more golf ball construction aspects, and (b) a selection criteria related to the one or more golf ball construction aspects. In another step, these methods include selecting the golf ball of the plurality of golf balls having the one or more configurations that meets the selection criteria.

In another aspect, some methods for selecting a golf ball based on environmental factors comprise steps of indicating, establishing, ascertaining, determining, identifying, and selecting. In one step, these method include indicating a golfing environment. In another step, these methods include establishing at least one environmental factor corresponding with the golfing environment. In another step, these methods include ascertaining a trajectory component dependent upon the at least one environmental factor. In another step, these methods include determining a golf ball construction aspect pertinent to the trajectory component. In another step, these methods include identifying (a) a plurality of golf balls, each golf ball of the plurality of golf balls having a different configuration of the golf ball construction aspect, and (b) a selection criteria related to the golf ball construction aspect. In another step, these methods include selecting the golf ball of the plurality of golf balls having the configuration of the golf ball construction aspect that meets the selection criteria.

In another aspect, some methods for selecting a golf ball for a golfer based on environmental factors comprises steps of indicating, establishing, ascertaining, determining, specifying, obtaining, identifying, and selecting. In one step, these methods include indicating a golfing environment. In another step, these methods include establishing at least one environmental factor corresponding with the golfing environment. In another step, these methods include ascertaining a trajectory component dependent upon the at least one environmental factor. In another step, these methods include determining one or more golf ball construction aspects pertinent to the trajectory component. In another step, these methods include specifying one or more golf swing parameters having an interaction with the one or more golf ball construction aspects. In another step, these methods include obtaining one or more swing parameter values corresponding respectively with each of the one or more golf swing parameters for the golfer. In another step, these methods include identifying (a) a plurality of golf balls, each golf ball of the plurality of golf balls having a configuration of the golf ball construction aspect, and (b) a selection criteria related to the one or more golf ball construction aspects. In another step, these methods include selecting the golf ball of the plurality of golf balls having the configuration of the one or more golf ball construction aspects that best meets the selection criteria when combined with the one or more swing parameter values.

Other systems, methods, features, and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale; instead, emphasis is placed upon illustrating the principles of the invention. Moreover, in the figures, like reference numerals designate corresponding parts throughout the different views.

FIG. 27 is a table containing carry distances at different elevations for balls having various different dimple configurations;

DETAILED DESCRIPTION

Methods for selecting a golf ball based on environmental factors are provided, as well as methods for selecting a golf ball for a golfer based on environmental factors.

Golfing Environments and Golf Ball Trajectories

A golfing environment, such as a golf course, may be associated with one or more environmental factors. In some cases, the environmental factors may be characteristics or properties associated with the location of the golfing environment, including, but not limited to: altitude or elevation; moisture content or humidity; temperature; wind speed; and visible landscape characteristics. In other cases, the environmental factors may be characteristics or properties associated with a specific golfing environment, such as a particular golf course, including but not limited to: grass type; green speed; course length; and course slope rating. In addition, other environmental factors may be associated with a given golfing environment.

In some cases, environmental factors associated with a golfing environment may change depending on the time of year or on a particular day. For example, wind speed, temperature, and humidity may vary at the same location or golf course at different times, thus presenting different golfing environments. Accordingly, real-time weather conditions or forecast information may be used to determine some environmental factors. On the other hand, some environmental factors associated with a golfing environment may remain substantially constant. For example, an altitude or elevation, range of moisture content or humidity, range of temperatures, grass type, and visible landscape characteristic, may be substantially the same at the same location throughout the year and from day to day. Thus, environmental factors associated with a golfing environment may include varying environmental factors, constant environmental factors, or both.

Meanwhile, one or more aspects of golf ball construction may vary between a first golf ball and a second golf ball. Due to the differences in the golf ball construction aspects of the two golf balls, a trajectory travelled by the first golf ball may differ from a trajectory travelled by the second golf ball with respect to one or more trajectory components. However, trajectories travelled by the first golf ball and the second golf ball may differ in one way in one golfing environment, and may differ in another way in another golfing environment. That is, the first golf ball may perform better than the second ball in one golfing environment, and the second golf ball may perform better than the first golf ball in another golfing environment.

Figure 1:
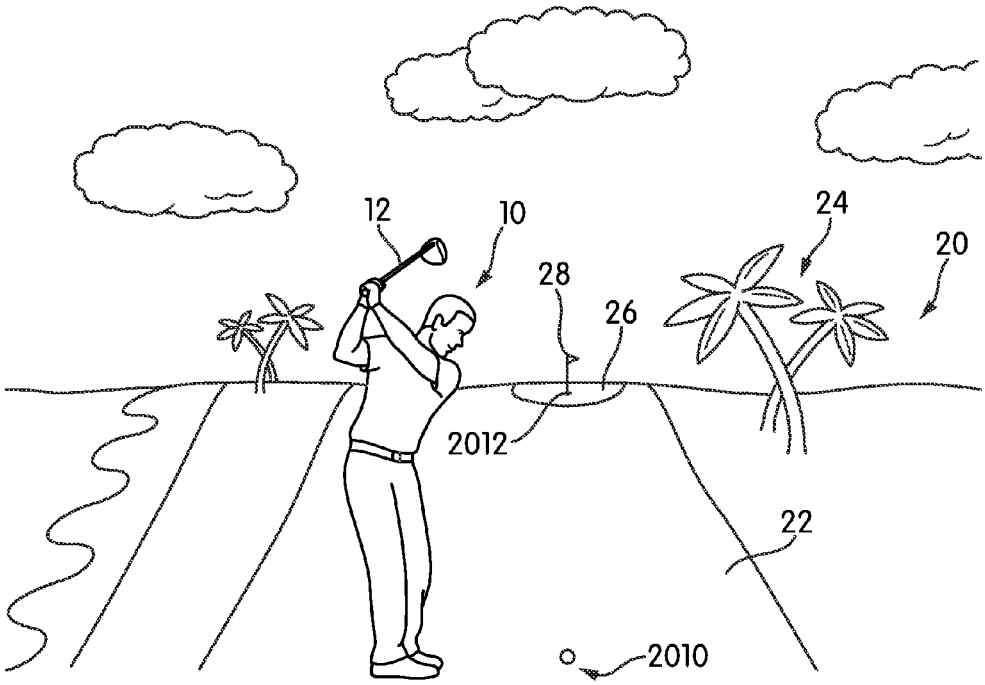
FIG. 1 depicts a golfer beginning a golf swing in a first golfing environment.

A first example is examined in detail with reference to FIGS. 1-10. FIG. 1 depicts a first golfing environment 20. First golfing environment 20 includes a first fairway 22, a first rough 24, a first green 26, and a first hole 28, and may be a golf course. First golfing environment 20 is located at a substantially low elevation and has a substantially high humidity, of the sort that might characterize a tropical beach.

A golfer 10 is playing a game of golf in first golfing environment 20. Golfer 10 is on first fairway 22 and is swinging a first golf club 12 at a golf ball located at a first lie spot 2010. In swinging, golfer 10 is aiming to strike the golf ball and hit it toward a first target spot 2012 at first hole 28. Since golfer 10 is relatively far away from first green 26 and first target spot 2012, first golf club 12 is depicted as being a golf club suitable for hitting a golf ball relatively long distances, such as a driver (i.e., a wood), or a low-numbered iron, or a hybrid club.

Figure 2:
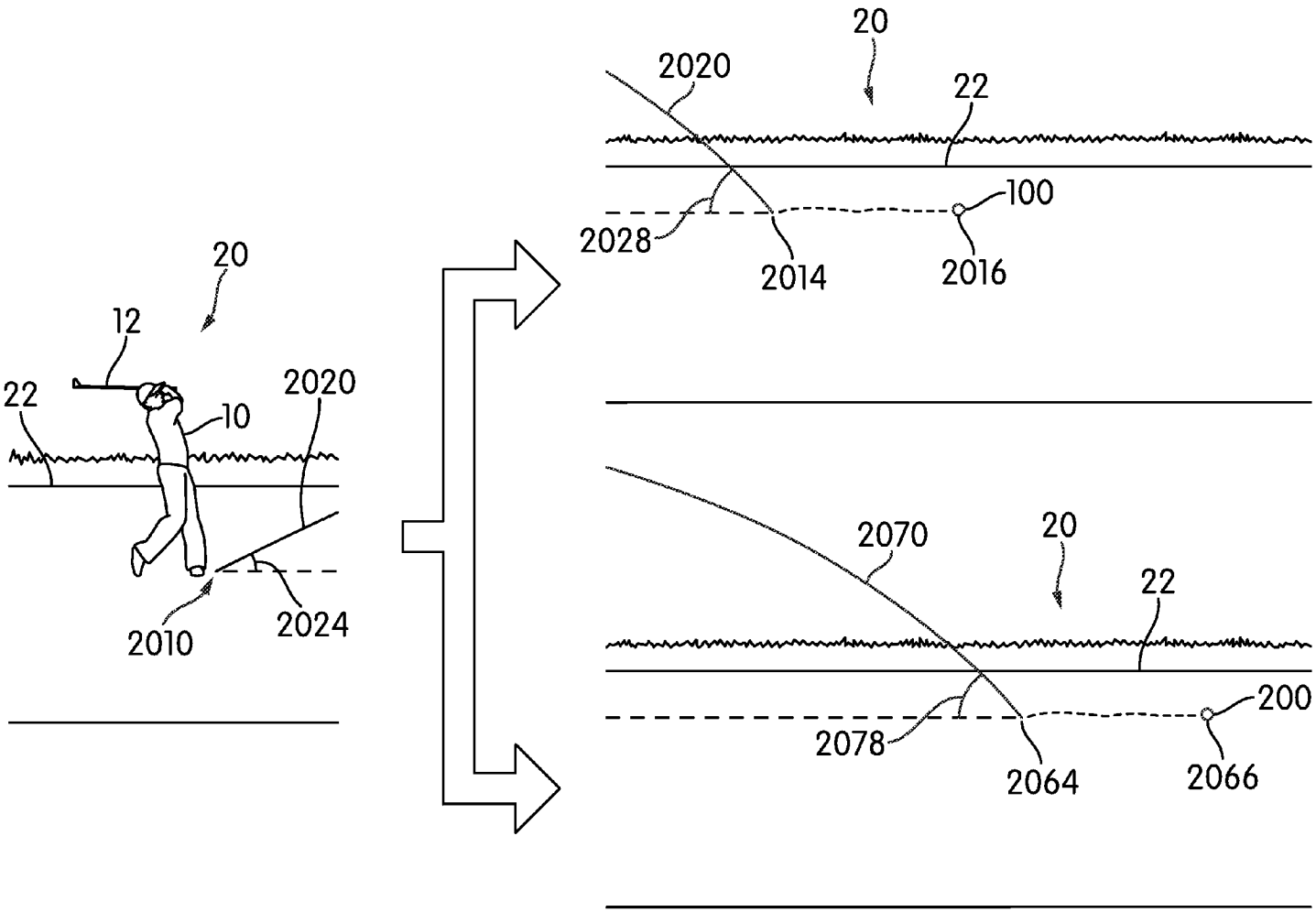
FIG. 2 is a side elevational view depicting portions of a first trajectory travelled by a first embodiment of a golf ball and portions of a second trajectory travelled by a second embodiment of the golf ball in the first golfing environment.
Figure 3:
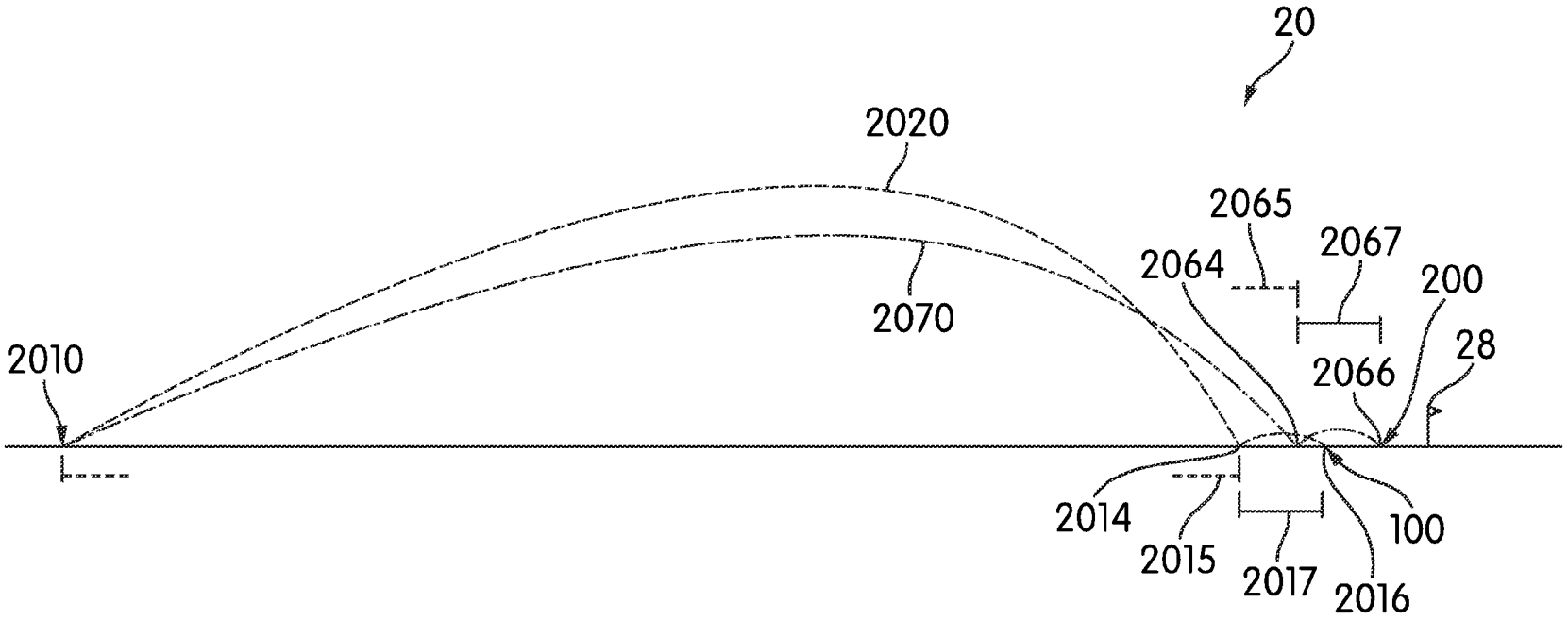
FIG. 3 is a side elevational view depicting the first trajectory and the second trajectory in the first golfing environment.
Figure 4:
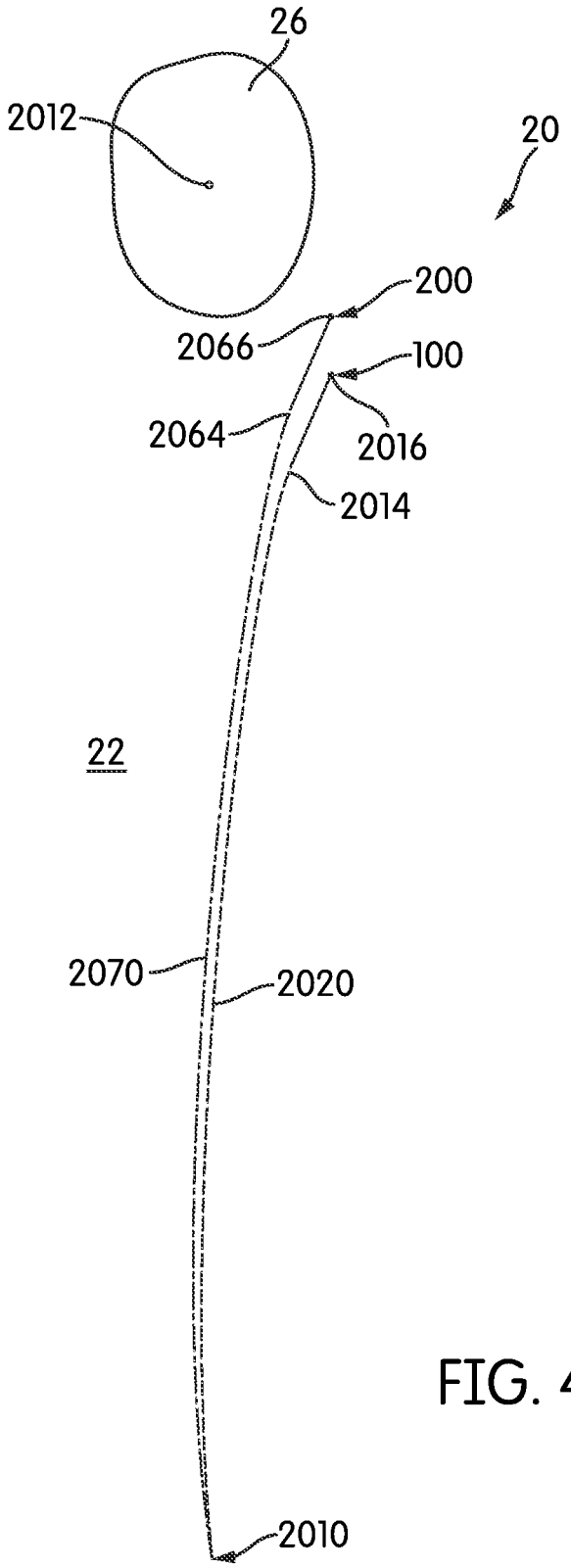
FIG. 4 is a top plan view depicting the first trajectory and the second trajectory in the first golfing environment.

FIGS. 2-4 depict the results when substantially the same golf swing depicted in FIG. 1 is taken, alternately, to hit two different golf balls. In a first golf swing, golfer 10 in first golfing environment 20 has swung at and struck a first golf ball 100, sending first golf ball 100 toward target spot 2012. Upon hitting first golf ball 100, golfer 10 has imparted first trajectory 2020 to first golf ball 100. First trajectory 2020 spans a first total distance 2018, which includes a first carry distance 2015 and a first roll distance 2017.

First carry distance 2015 is the distance between first lie spot 2010 and a first contact spot 2014 where golf ball 100 strikes the ground after being hit. At an initial portion of first carry distance 2015 close to first lie spot 2010, golf ball 100 leaves first fairway 22, travelling at a first initial angle 2024 with respect to ground and at a first initial velocity. Shortly thereafter, at a final portion of first carry distance 2015, first golf ball 100 hits first contact spot 2014 travelling at a first final velocity and at a first final angle 2028. First roll distance 2017 is the distance between first contact spot 2014 and a first stopping spot 2016 where golf ball 100 comes to rest on first fairway 22.

In an alternate second golf swing, golfer 10 in first golfing environment 20 has instead swung at and struck a second golf ball 200, sending second golf ball 200 toward target spot 2012. Golfer 10 imparts second trajectory 2070 to second golf ball 200 upon hitting it. In a manner similar to first trajectory 2020, second trajectory 2070 spans a second total distance 2068 including a second carry distance 2065 and a second roll distance 2067.

Second carry distance 2065 is the distance between first lie spot 2010 and a second contact spot 2064 where golf ball 200 strikes the ground after being hit. Close to first lie spot 2010, at an initial portion of second carry distance 2065, golf ball 200 leaves first fairway 22 at a second initial velocity and at a second initial angle with respect to ground (which may be substantially the same, respectively, as the first initial velocity and first initial angle 2024). Similarly, second golf ball 200 hits second contact spot 2064 travelling at a second final velocity and at a second final angle 2078. Second roll distance 2067 is the distance between second contact spot 2064 and a second stopping spot 2066 where golf ball 200 comes to rest on first fairway 22.

Figure 5:
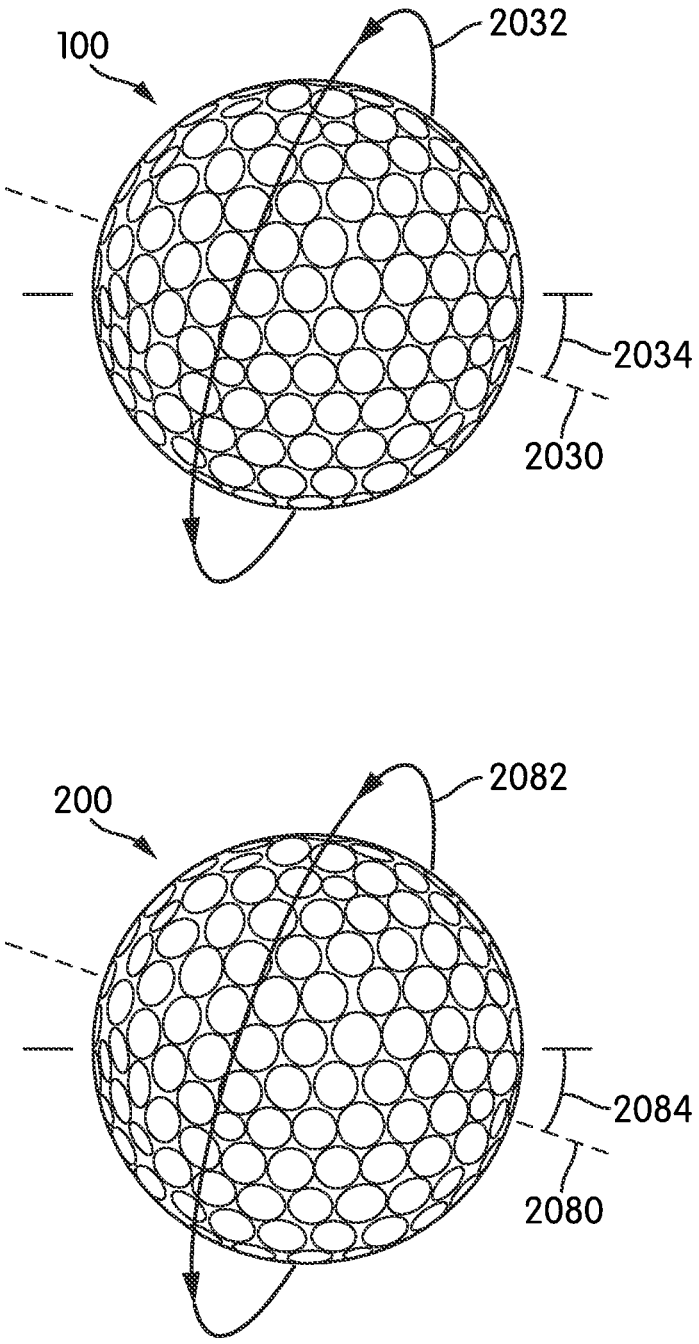
FIG. 5 is a rear view depicting the first embodiment of the golf ball in flight along the first trajectory and the second embodiment of the golf ball in flight along the second trajectory in the first golfing environment.

As depicted in FIGS. 4-5, first golf ball 100 travelling along first trajectory 2020 has a first back-spin 2032 about a first spin axis 2030, which was imparted by first golf club 12. First spin axis 2030 is not precisely horizontal, and is instead at a non-zero first side spin angle 2034 with respect to a horizontal axis. In other words, first golf club 12 imparted a non-level back-spin to first golf ball 100. First trajectory 2020 does not extend at a straight line from first lie spot 2010. Instead, as a result of first back spin 2032 about first spin axis 2030, first trajectory 2020 curves to the right as first golf ball 100 flies toward first target spot 2012.

Similarly, second golf ball 200 travelling along second trajectory 2070 has a second back-spin 2082 about a second spin axis 2080, which was imparted to second golf ball 200 when it was struck by first golf club 12. As with first golf ball 100, first golf club 12 imparted a non-level back-spin to second golf ball 200. Second spin axis 2080 is accordingly at a non-zero second side spin angle 2084 with respect to the horizontal axis. As a result of second back spin 2084 about second spin axis 2080, second trajectory 2070 also curves to the right as second golf ball 200 flies toward first target spot 2012.

In other words, as depicted in FIGS. 1-5, although golfer 10 has made substantially the same swing in hitting second golf ball 200 as was made in hitting first golf ball 100, first trajectory 2020 and second trajectory 2070 are significantly different. More particularly, second carry distance 2065 of second trajectory 2070 is greater than first carry distance 2015 of first trajectory 2020.

Figure 6:
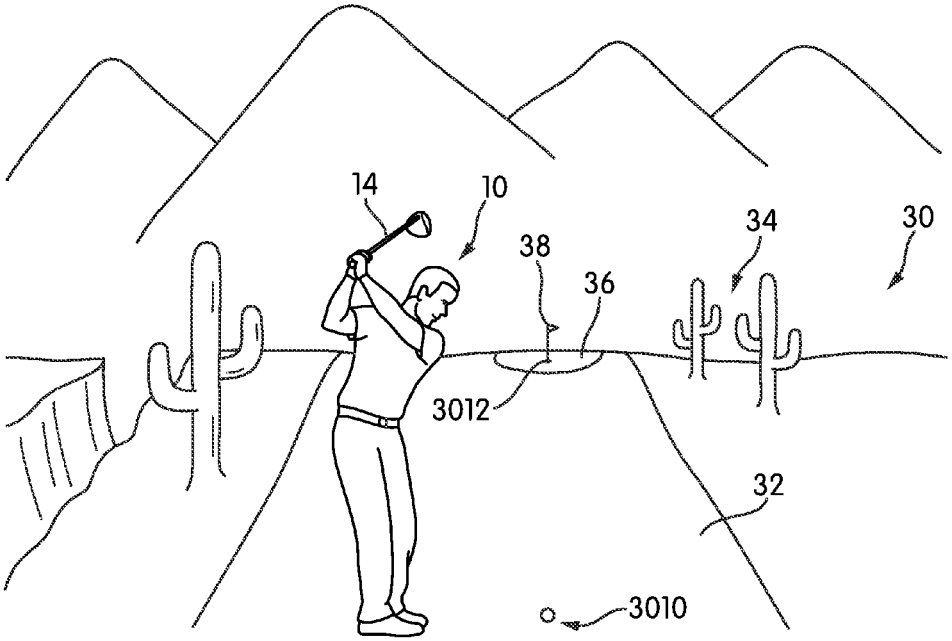
FIG. 6 depicts the golfer beginning a golf swing in a second golfing environment.

FIG. 6 depicts a second golfing environment 30, which may also be a golf course, and which includes a second fairway 32, a second rough 34, a second green 36, and a second hole 38. In contrast with first golfing environment 20, second golfing environment 30 is located at a substantially high elevation and has a substantially low humidity, of the sort that might characterize a high desert region.

Golfer 10 is playing another game of golf in second golfing environment 30. Golfer 10 is swinging a second golf club 14 at a golf ball located at a third lie spot 3010 on second fairway 32. Golfer 10 is aiming to swing at and strike the golf ball to hit it toward third target spot 3012 at second hole 38. Again, since golfer 10 is relatively far away from second green 36 and third target spot 3012, second golf club 14 is depicted as being a golf club suitable for hitting a golf ball relatively long distances. (As depicted, golf club 14 is substantially similar to golf club 12.)

Figure 7:
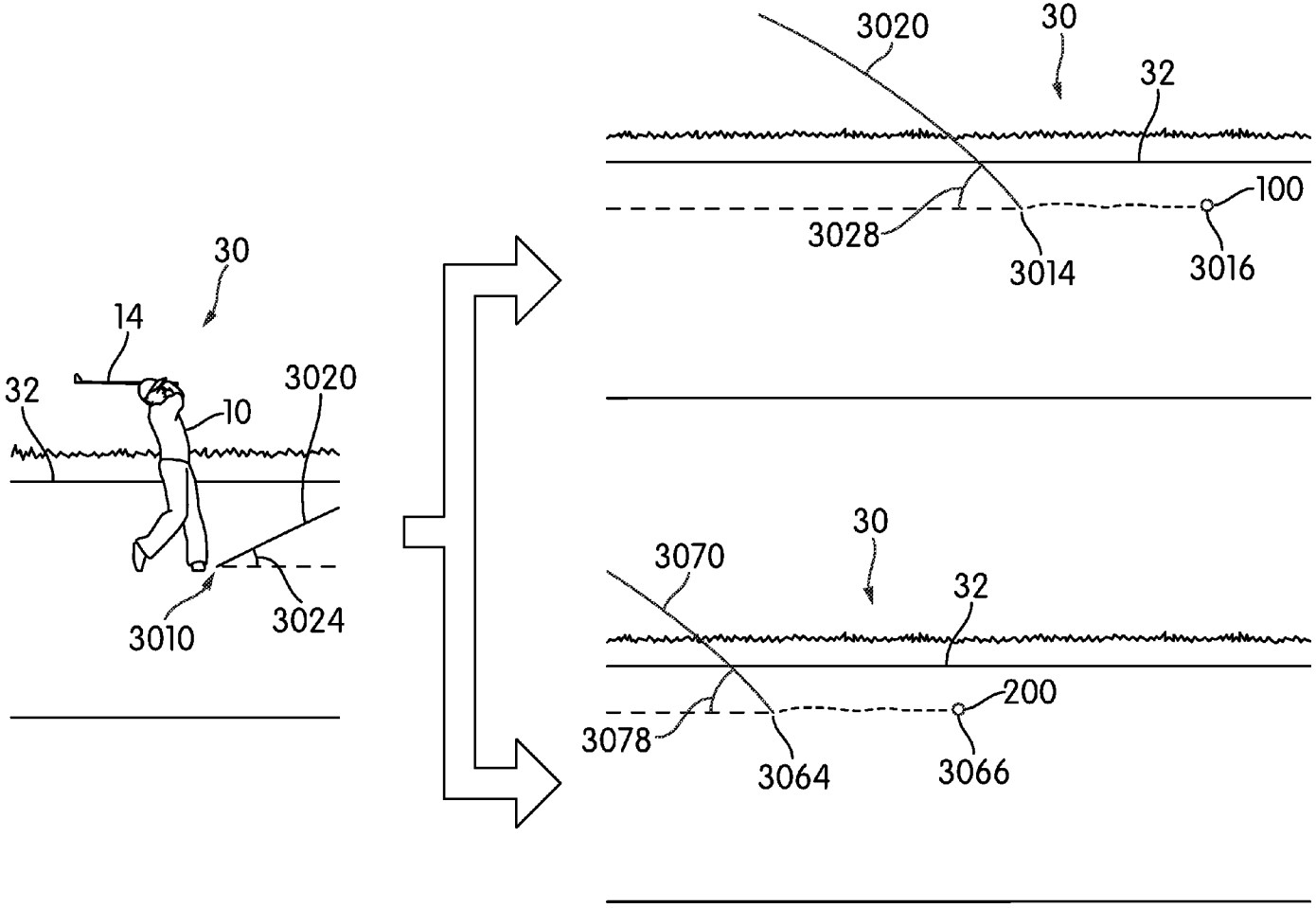
FIG. 7 is a side elevational view depicting portions of a third trajectory travelled by the first embodiment of the golf ball and portions of a second trajectory travelled by the second embodiment of the golf ball in the second golfing environment.
Figure 8:
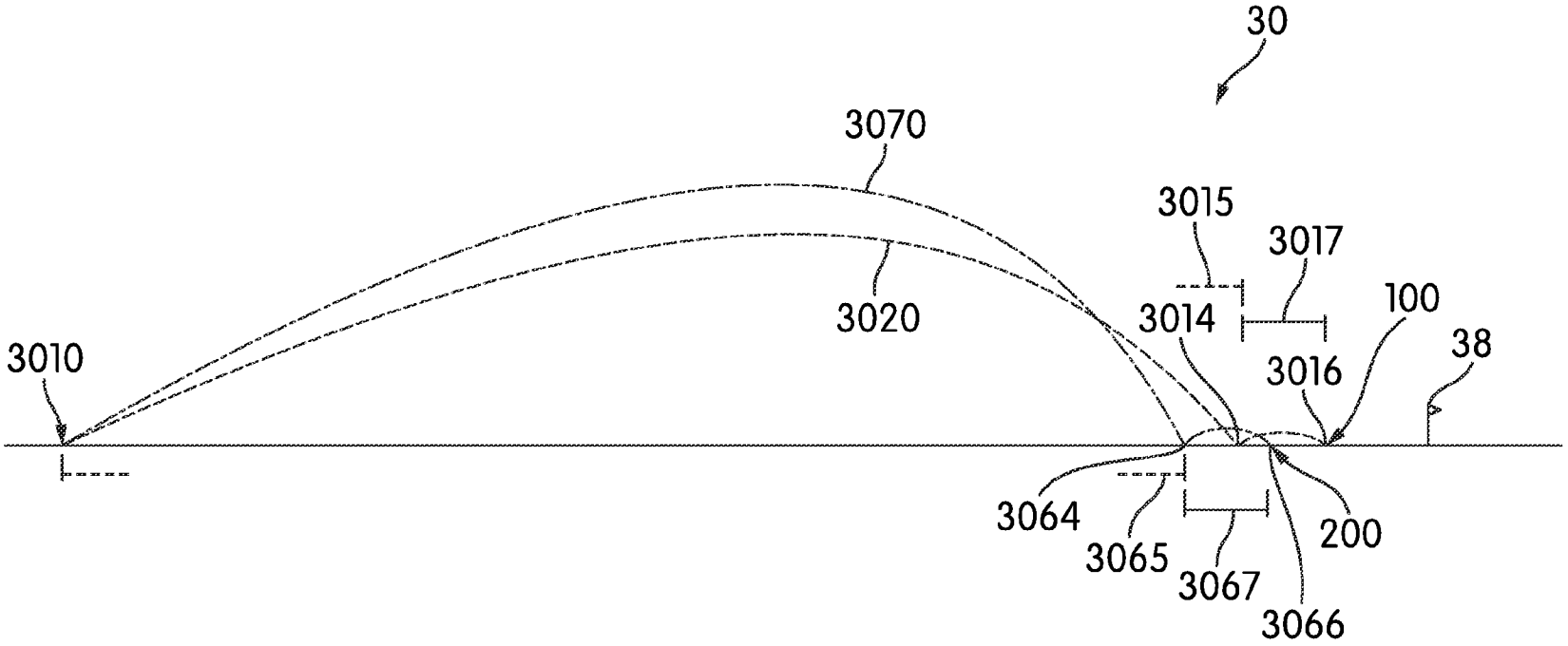
FIG. 8 is a side elevational view depicting the third trajectory and the fourth trajectory in the second golfing environment.
Figure 9:
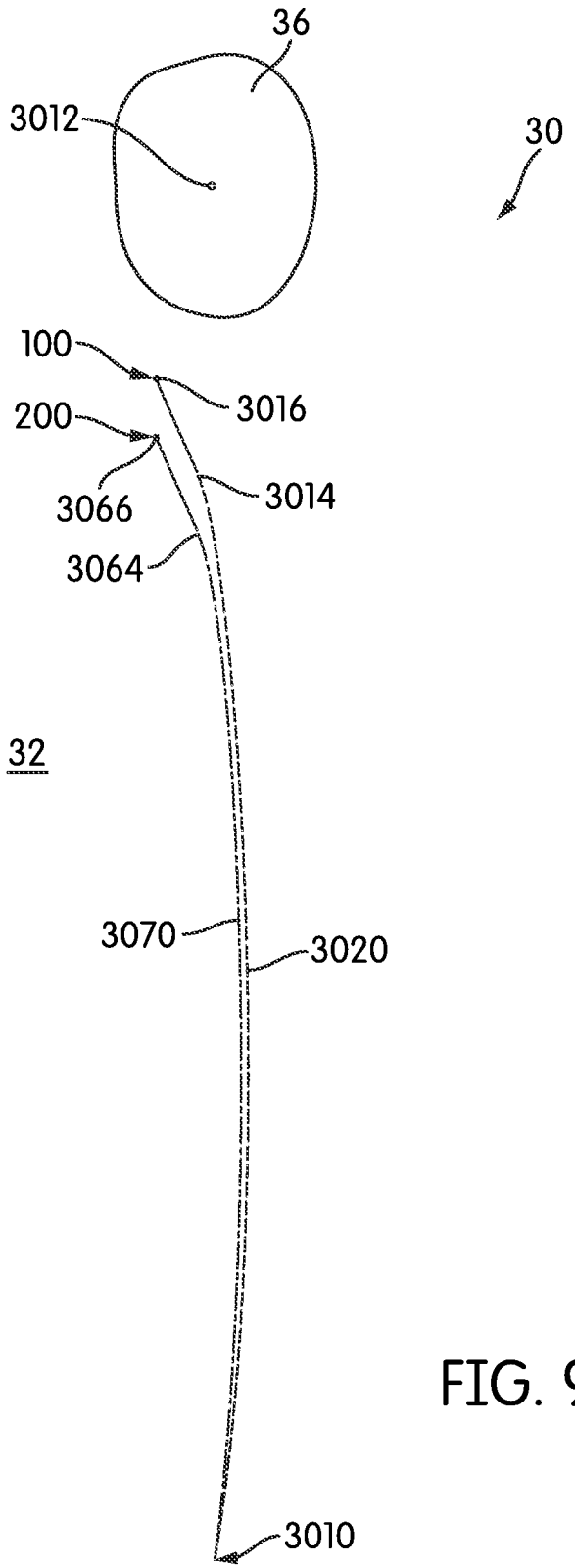
FIG. 9 is a top plan view depicting the third trajectory and the fourth trajectory in the second golfing environment.

FIGS. 7-9 depict the results of the golf swing depicted in FIG. 6 as taken alternatively against first golf ball 100 and second golf ball 200. In a third golf swing, golfer 10 in second golfing environment 30 has swung at and struck first golf ball 100 toward third target spot 3012, imparting a third trajectory 3020 to first golf ball 100. Third trajectory spans a third total distance 3018, including a third carry distance 3015 and a third roll distance 3017.

Third carry distance 3015 extends from third lie spot 3010 to third contact spot 3014. At an initial portion of third carry distance 3015, golf ball 100 leaves fairway 32, travelling at a third initial velocity and at a third initial angle 3024 with respect to ground. Then, at a final portion of third carry distance 3015, first golf ball 100 travelling at a third final velocity hits third contact spot 3014 at a third final angle 3028. Third roll distance 3017 extends from third contact spot 3014 to third stopping spot 3016.

In an alternate fourth golf swing, golfer 10 in second golfing environment 30 has instead swung at and struck second golf ball 200 toward third target spot 3012, imparting a fourth trajectory 3070 to second golf ball 200. Fourth trajectory 3070 spans a fourth total distance 3068 which includes a fourth carry distance 3065 and a fourth roll distance 3067.

Fourth carry distance 3065 extends from third lie spot 3010 to fourth contact spot 3064. At an initial portion of fourth carry distance 3015, golf ball 200 leaves second fairway 32 at a fourth initial velocity and at a fourth initial angle with respect to ground, which may be substantially the same as the third initial velocity and third initial angle 3024, respectively. Second golf ball 200, travelling at a fourth final velocity, then hits fourth contact spot 3064 at a fourth final angle 3078. Fourth roll distance 3067 extends from fourth contact spot 3064 to fourth stopping spot 3066.

Figure 10:
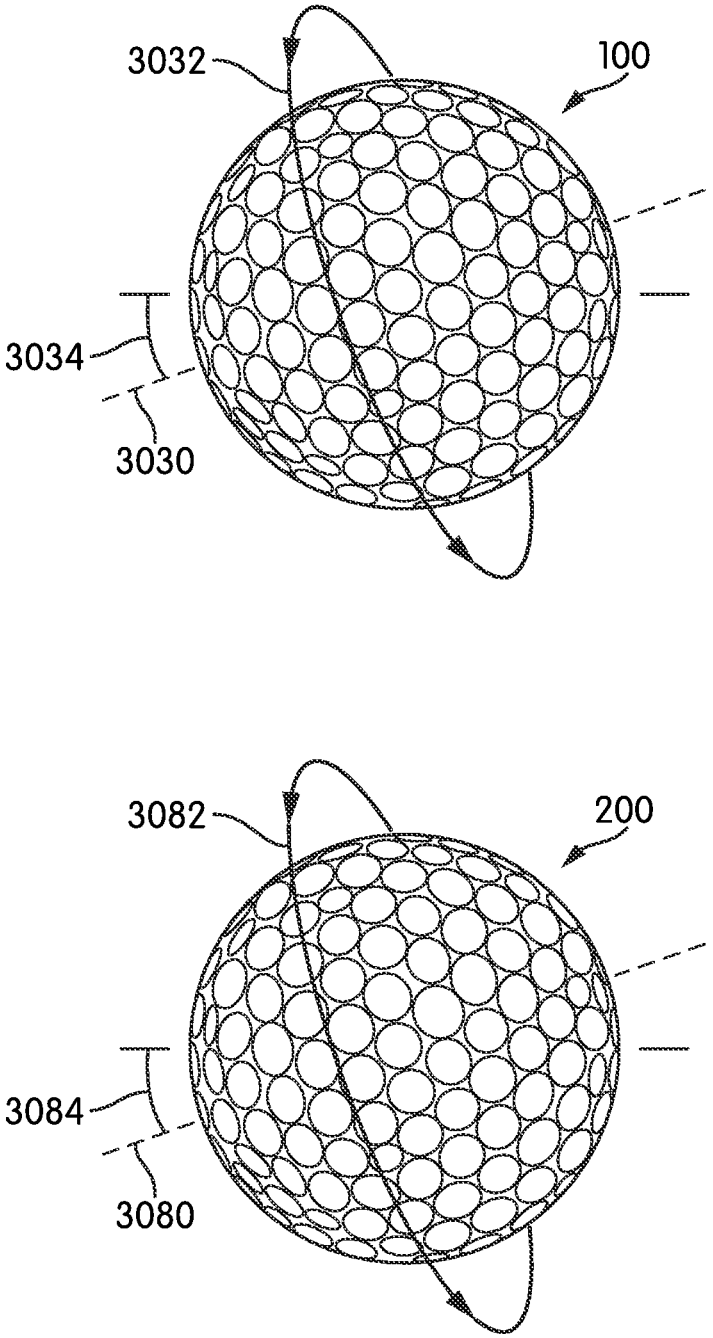
FIG. 10 is a rear view depicting the first embodiment of the golf ball in flight along the third trajectory and the second embodiment of the golf ball in flight along the fourth trajectory in the second golfing environment.

As depicted in FIGS. 9-10, first golf ball 100 travels along third trajectory 3020 and has a third back-spin 3032, imparted by second golf club 14, about a third spin axis 3030. Third spin axis 3030 is non-horizontal and is at a non-zero third side spin angle 3034. As a result, third trajectory 3020 does not extend at a straight line from third lie spot 3010, and instead curves to the left as first golf ball 100 flies toward third target spot 3012.

In a similar fashion, second golf ball 200 travelling along fourth trajectory 3070 has a fourth back-spin 3082 about a fourth spin axis 3080, as imparted to it by second golf club 14. Fourth spin axis 3080 is at a non-zero fourth side spin angle 3084 with respect to the horizontal axis. Due to fourth back spin 3084 about fourth spin axis 3080, fourth trajectory 3070 also curves to the left as second golf ball 200 flies toward third target spot 3012

As depicted in FIGS. 6-10, golfer 10 has made substantially the same swing in hitting both first golf ball 100 and second golf ball 200. However, third trajectory 3020 and fourth trajectory 3070 are significantly different. Third carry distance 3015 of third trajectory 3020 is greater than fourth carry distance 3065 of fourth trajectory 3070.

With respect to carry distance, second golf ball 200 performs better than first golf ball 100 in first golfing environment 20, and first golf ball 100 performs better than second golf ball 200 in second golfing environment 30. More particularly, golf balls 100 and 200 struck with substantially the same swing in first golfing environment 20 as depicted in FIGS. 1-5 (which may be at a relatively low elevation and may have a relatively high humidity), and may also be struck with substantially the same swing in second golfing environment 30 as depicted in FIGS. 6-10 (which may be at a relatively high elevation and may have a relatively low humidity)

In summary, FIGS. 1-5 depict golf balls 100 and 200 struck with substantially the same swing in first golfing environment 20, which may be at a relatively low elevation and may have a relatively high humidity. After being struck, second carry distance 2065 imparted to second golf ball 200 is greater than first carry distance 2015 imparted to first golf ball 100. In contrast, FIGS. 6-10 depict golf balls 100 and 200 struck with substantially the same swing in second golfing environment 30, which may be at a relatively high elevation and may have a relatively low humidity. After being struck, third carry distance 3015 imparted to first golf ball 100 is greater than fourth carry distance 3065 imparted to second golf ball 200.

In other words, with respect to carry distance, second golf ball 200 performs better given the same swing than first golf ball 100 in first golfing environment 20, and first golf ball 100 performs better given the same swing than second golf ball 200 in second golfing environment 30. Accordingly, the difference in performance between golf balls 100 and 200 may be attributable to differences in golf balls 100 and 200 themselves. That is, golf balls 100 and 200 perform differently because golf balls 100 and 200 have different designs.

Aspects of Golf Ball Construction

As used herein, unless otherwise stated, the terms below are defined as follows.

The term "hardness" as used herein is measured generally in accordance with ASTM D-2240. The hardness of a golf ball is measured on the land area of a curved surface of a molded ball. The hardness of a golf ball sub-component is measured on the curved surface of the molded sub-component. The hardness of a material is measured in accordance with ASTM D-2240 (on a plaque).

The term "compression deformation" as used indicates the deformation amount of the ball, or any portion thereof, under a force; specifically, when the force is increased to become 130 kg from 10 kg, the deformation amount of the ball or portion thereof under the force of 130 kg reduced by the deformation amount of the ball or portion thereof under the force of 10 kg is the compression deformation value of the ball or portion thereof.

The term "coefficient of restitution" ("COR") as used herein is measured according to the method: a golf ball or golf ball sub-component is fired by an air cannon at an initial velocity of 40 m/sec, and a speed monitoring device is located over a distance of 0.6 to 0.9 meters from the cannon. The golf ball or golf ball sub-component strikes a steel plate positioned about 1.2 meters away from the air cannon, and then the golf ball or golf ball sub-component rebounds through the speed-monitoring device. The COR is the return velocity divided by the initial velocity.

FIGS. 11-25 show certain embodiments of golf balls in accordance with this disclosure. Except as otherwise discussed herein below, any golf ball discussed herein may generally be any type of golf ball known in the art. Namely, unless the present disclosure indicates to the contrary, a golf ball may generally be of any construction conventionally used for golf balls, and may be made of any of the various materials known to be used in golf ball manufacturing. Furthermore, it is understood that any feature disclosed herein (including but not limited to various embodiments shown in the FIGS. and various chemical formulas or mixtures) may be combined with any other features disclosed here in any combination or sub-combination, as may be desired.

In FIGS. 1-10, each of first golf ball 100 and second golf ball 200 has been manufactured in accordance with a corresponding golf ball design. Each golf ball design in turn specifies configurations for a number of aspects of golf ball construction, which specify something about the nature of one or more portions of golf balls 100 and 200. In other words, golf balls 100 and 200 are differently configured in one or more golf ball construction aspects. These different configurations of various golf ball construction aspects cause golf balls 100 and 200 to perform differently in a given golfing environment.

Pertinent golf ball construction aspects may include, but are not limited to: a number of pieces or layers of construction; a physical characteristic of a layer, such as a cover thickness, or a thickness of another layer; a material of a layer, such as a cover material; a physical characteristic of a material of a layer, such as a cover hardness or density, or a hardness or density of a material of another layer; a moment of inertia; a compression deformation; a coefficient of restitution; a dimple characteristic, such as a shape, depth, or other dimension of the dimples in the golf ball's cover; a dimple pattern, such as a number or arrangement of the dimples; and a visible cover characteristic, such as such as color or indicia. Other golf ball construction aspects may include other aspects of design affecting the physical response of the golf ball to external stimulus.

Figure 11:
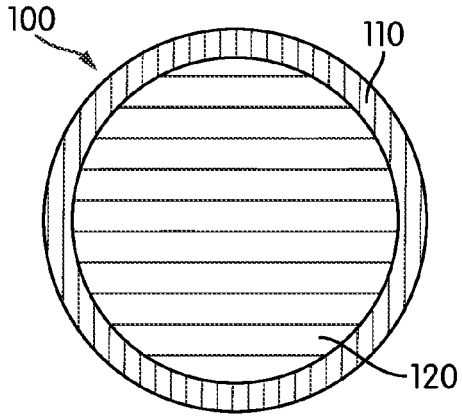
FIG. 11 is a schematic cross-sectional view depicting a number of portions of the first embodiment of the golf ball.
Figure 12:
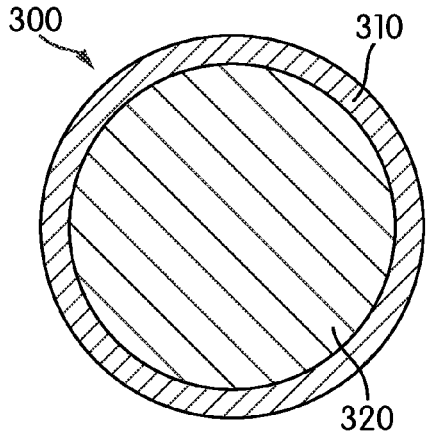
FIG. 12 is a schematic cross-sectional view depicting a number of portions of a third embodiment of the golf ball.
Figure 13:
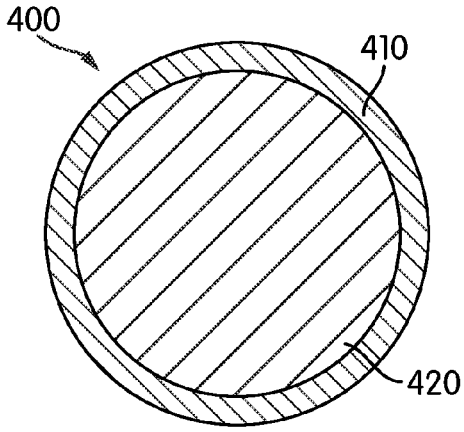
FIG. 13 is a schematic cross-sectional view depicting a number of portions of a fourth embodiment of the golf ball.

Accordingly, various golf ball construction aspects may be configured differently in first golf ball 100 than in other golf balls. For example, as depicted in FIGS. 11-13, first golf ball 100 is depicted as having a first cover portion 110 and a first core portion 120. Similarly, a third golf ball 300 is depicted as having a third cover portion 310 and a third core portion 320, while a fourth golf ball 400 is depicted as having a fourth cover portion 410 and a fourth core portion 420.

Figure 14:
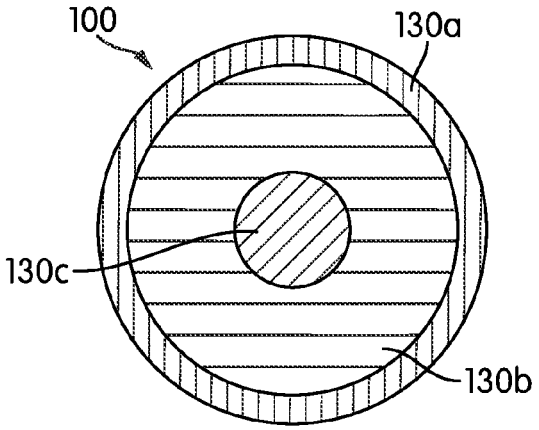
FIG. 14 is a schematic cross-sectional view depicting a number of layers of the first embodiment of the golf ball.
Figure 15:
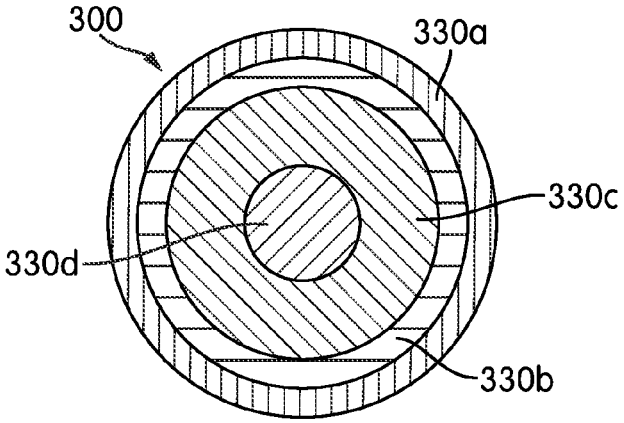
FIG. 15 is a schematic cross-sectional view depicting a number of layers of the third embodiment of the golf ball.
Figure 16:
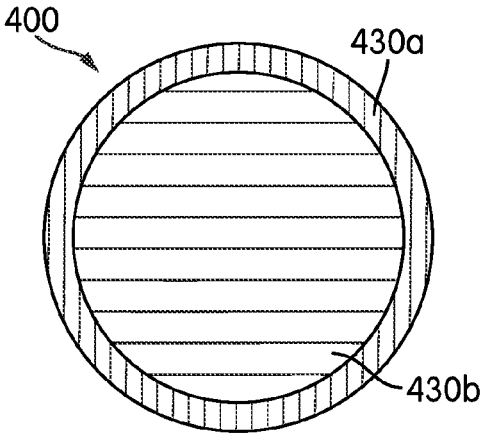
FIG. 16 is a schematic cross-sectional view depicting a number of layers of the fourth embodiment of the golf ball.

Cover portions 110, 310, and 410 may form outer portions of golf balls 100, 300, and 400, respectively, and may include one or more pieces or layers construction which may be formed of various materials. Cover portions 110, 310, and 410 may additionally include dimples arranged in patterns. Core portions 120, 320, and 420 may form inner portions of golf balls 100, 300, and 400. Core portions 120, 320, and 420 may also include one or more pieces or layers of construction, which may be formed of various materials. For example, as depicted in FIGS. 14-16, first golf ball 100 includes three layers 130*a*-130*c*, while third golf ball 300 includes four layers 330*a*-330*d* and fourth golf ball 400 includes only two layers 430*a*-430*b*. Some of these pieces or layers of construction may be included in core portions 120, 320, and 420, while other pieces or layers of construction may be included in cover portions 110, 310, and 410.

Each piece or layer of construction used for cover portions 110, 310, and 410 as well as for core portions 120, 320, and 420 may have physical characteristics, such as a thickness, and may be formed from any of a variety of materials. Each material used to form a piece or layer of construction may in turn have physical characteristics such as density, and hardness, for example. Moreover, a physical characteristic of the material within a particular piece or layer of construction may vary within that piece or layer. The physical characteristic of the material of the piece or layer may not be constant throughout the piece or layer, but may be vary as a function of, for example, a distance at each point within the material from the center of the golf ball. That is, the physical characteristic may be a gradient within the material.

Generally, for any arrangement of layers not specifically mentioned herein, any layer may be made of any material suitable for the purpose. Suitable known materials for use in a golf ball include thermoset materials, such as rubber, styrene butadiene, polybutadiene, isoprene, polyisoprene, and trans-isoprene. Known materials also include thermoplastics, such as ionomer resins, polyamides or polyesters, and thermoplastic polyurethane elastomers. Suitable materials also include polyurea compositions, as well as other materials.

For example, a cover layer should be tough and resistant to scuffing while being soft enough for a golf club to impart spin easily to the ball. Thus, thermoplastic polyurethane (TPU) and thermoset polyurethane are suitable for use in cover layers, as are known highly neutralized polymers and other ionomers. Thermoplastic polyurethane that is not otherwise scuff resistant can be treated to harden the surface, such as by a surface treatment. Suitable ionomers include members of the Surlyn® family of ionomeric polymers produced by E. I. DuPont de Nemours and Company and members of the Lotek® family of products produced by ExxonMobil Chemical Corporation.

FIG. 14 depicts first golf ball 100 as a three-piece golf ball having a cover layer 130*a*, an outer core layer 130*b*, and a relatively smaller inner core layer 130*c*. Although depicted in FIG. 14 as having a relatively small inner core layer 130*c*, in other embodiments, first golf ball 100 may have a relatively large inner core layer 130*c*. In such embodiments, outer core layer 130*b* and cover layer 130*c* may essentially comprise an inner cover layer and an outer cover layer. Similarly, FIG. 15 depicts third golf ball 300 as a four-piece golf ball having an inner core layer 330*d*, an outer core layer 330*c*, an inner cover layer 330*b*, and an outer cover layer 330*a*, while FIG. 16 depicts fourth golf ball 400 as a two layer or "two-piece" golf ball having a core layer 430*b* substantially surrounded by a cover layer 430*a*.

Although described above as having 2, 3, or 4 layers or pieces, the discussion herein below may be directed to golf balls having at least 2 layers, and as many as 5, 6, or 7 layers, or more. The number of layers in the golf ball is limited only by any rules extant at the time of manufacture regarding specifications for 'regulation' or 'conforming' golf balls.

Given the specific arrangement of pieces or layers included in the cover portions and the core portions, the physical characteristics of the pieces or layers and the physical characteristics of the materials forming the pieces or layers may influence other physical characteristics of golf balls 100, 300, and 400. For example, the specific arrangement of pieces or layers in each of golf balls 100, 300, and 400 may impart a particular moment of inertia to each golf ball. In other words, golf balls 100, 300, and 400 may resist rotational changes on the basis of the specific arrangement of pieces or layers therein. Similarly, the specific arrangement of the pieces or layers in golf balls 100, 300, and 400 may impart a particular compression deformation to each golf ball, which may represent a composite or aggregate hardness of the golf ball.

Figure 17:
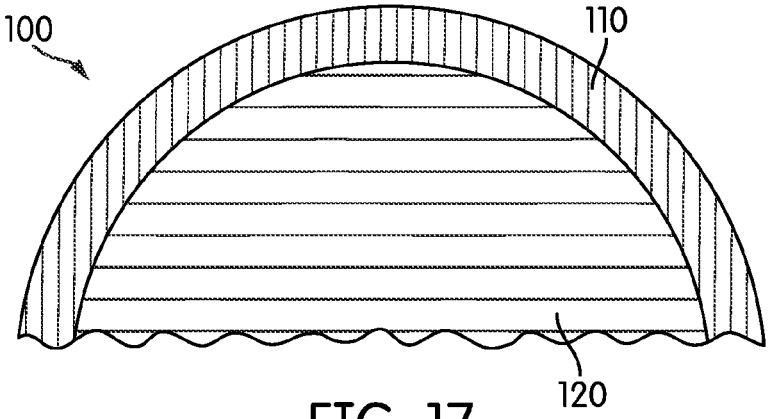
FIG. 17 is a schematic cross-sectional view depicting a cover material of the first embodiment of the golf ball.
Figure 18:
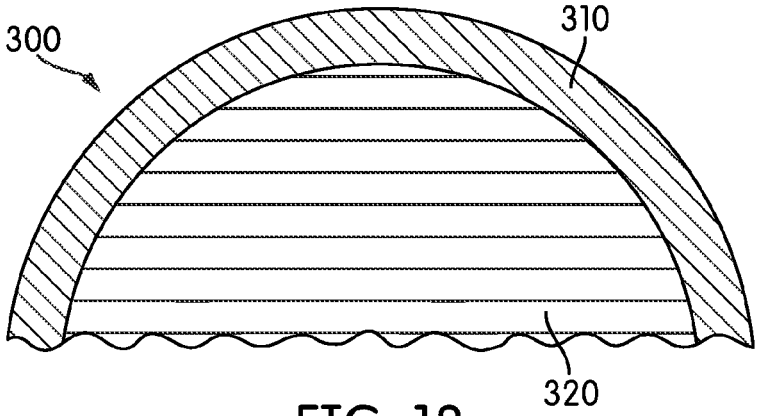
FIG. 18 is a schematic cross-sectional view depicting a cover material of the third embodiment of the golf ball.
Figure 19:
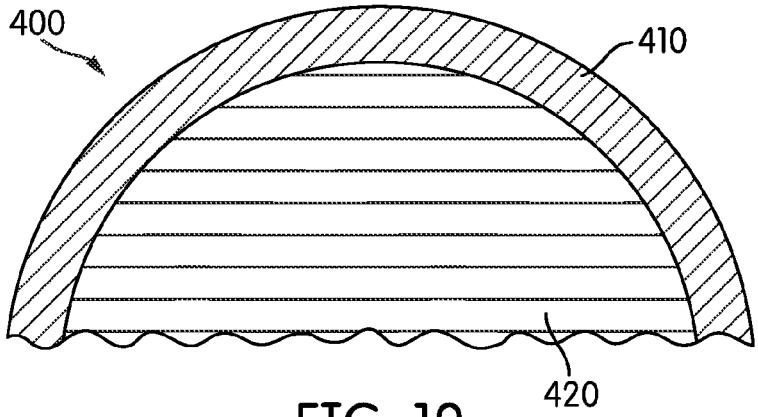
FIG. 19 is a schematic cross-sectional view depicting a cover material of the fourth embodiment of the golf ball.

As depicted in FIGS. 17-19, cover portions 110, 310, and 410 are formed from different materials having various physical characteristics. Cover portion 310 is formed from a material having a greater hardness than a material forming cover portion 110. In contrast, cover portion 410 is formed from a material having a lesser hardness than the material forming cover portion 110. Suitable materials for cover portions 110, 310, and 410 may include urethane or Surlyn®. Urethane incorporated into cover portions may have Shore-D hardnesses (i.e., Type D Shore Durometer hardnesses) from 40 to 60. Similarly, Surlyn® incorporated into cover portions may have Shore-D hardnesses from 50 to 70.

Figure 20:
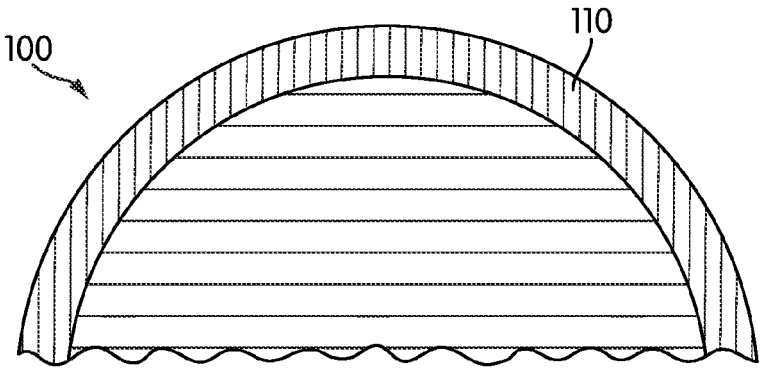
FIG. 20 is a schematic cross-sectional view depicting a cover thickness of the first embodiment of the golf ball.
Figure 21:
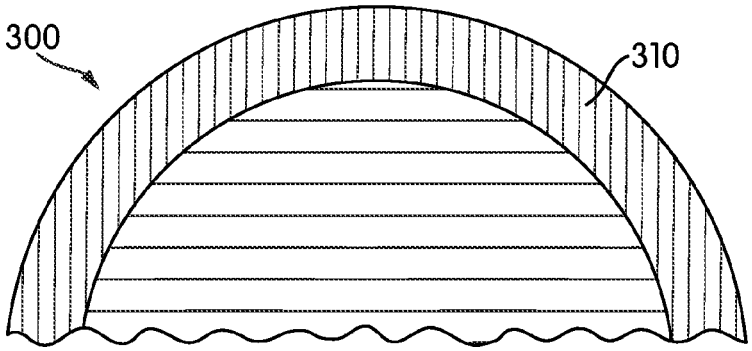
FIG. 21 is a schematic cross-sectional view depicting a cover thickness of the third embodiment of the golf ball.
Figure 22:
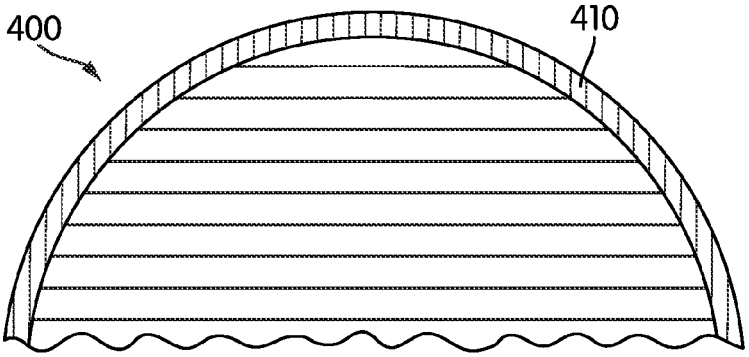
FIG. 22 is a schematic cross-sectional view depicting a cover thickness of the fourth embodiment of the golf ball.

Moreover, as depicted in FIGS. 20-22, cover portions 110, 310, and 410 are formed to have various thicknesses. Cover portion 310 is formed to have a thickness greater than the thickness of cover portion 110, while cover portion 410 is formed to have a thickness less than the thickness of cover portion 110. In various configurations, cover portions 110, 310, and 410 may be formed of a variety of materials having a variety of hardnesses, and may be formed to have a variety of thicknesses.

Figure 23:
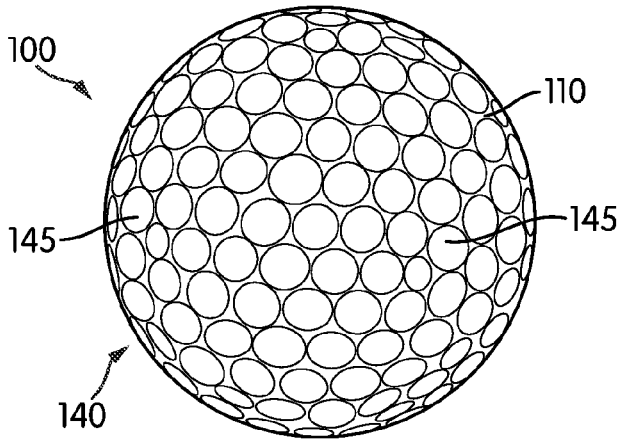
FIG. 23 is a schematic plan view depicting a dimple pattern of the first embodiment of the golf ball.
Figure 24:
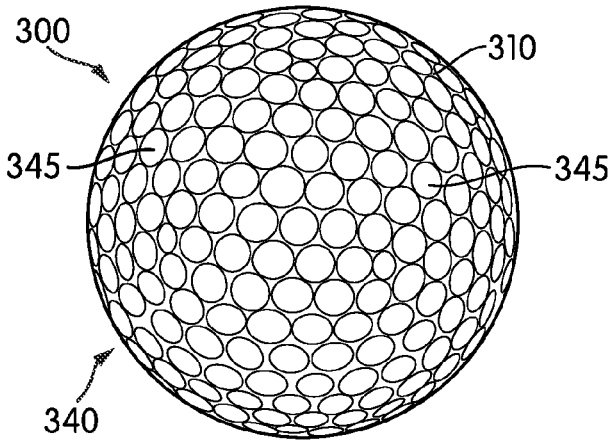
FIG. 24 is a schematic plan view depicting a dimple pattern of the third embodiment of the golf ball.
Figure 25:
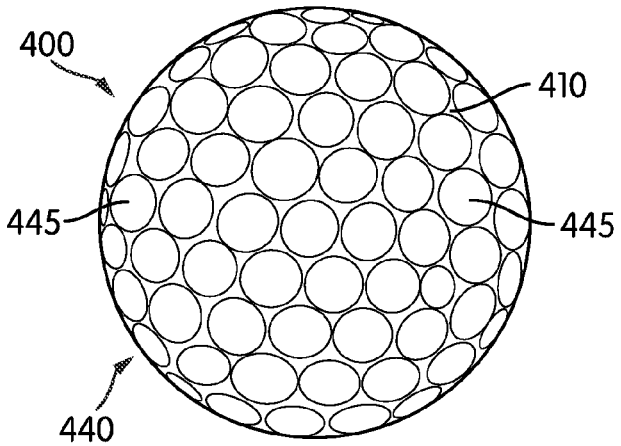
FIG. 25 is a schematic plan view depicting a dimple pattern of the fourth embodiment of the golf ball.

As a further example, FIGS. 23-25 depict golf balls 100, 300, and 400 having a variety of dimple patterns and dimple characteristics. For example, FIG. 24 depicts a third dimple pattern 340 having a greater number of dimples 345 than the number of dimples 145 of first dimple pattern 140. In contrast, FIG. 25 depicts a fourth dimple pattern 440 having a lesser number of dimples 445 than the number of dimples 145 of first dimple pattern 140.

Additionally, the characteristics of dimples 145 may be different from the characteristics of dimples 345 and 445, such as by varying in size, shape, or dimension. For example, dimples 345 may have a lesser dimension (i.e., in radius, in depth, or both) than a corresponding dimension of dimples 145, while dimples 445 may have a greater dimension than a corresponding dimension of dimples 145.

In second golf ball 200, one or more of the various aspects of golf ball construction may be configured in a different manner than those golf ball construction aspects in first golf ball 100. For example, various aspects of second golf ball 200 may be similar to corresponding aspects of third golf ball 300, or of fourth golf ball 400. Accordingly, in any particular golfing environment, golf balls 100 and 200 may perform differently as a result of configurations of one or more golf ball construction aspects that differ between golf balls 100 and 200.

Golf ball 100 may perform better than golf ball 200 in some golfing environments, and golf ball 200 may perform better than golf ball 100 in other golfing environments. In turn, a golfing environment may embody, exemplify, or otherwise possess one or more environmental factors affecting the performance of one of golf balls 100 and 200 more than the other, where the performance may be a particular component of a trajectory, such as a carry distance or a total distance. In addition, in other cases, performance of a golf ball may be determined in reference to other characteristics or properties associated with the trajectory or flight path of the golf ball, including, but not limited to, spin, loft height, or other aspects. Differences in various components of the trajectories of golf balls 100 and 200 in a particular golfing environment may be due to one or more of the differences in golf ball construction aspects between golf ball 100 and golf ball 200.

Put another way, a golfing environment may correspond with one or more environmental factors. These environmental factors may be pertinent to one or more components of golf ball trajectories. The golf ball trajectory components may in turn benefit from particular configurations of one or more aspects of golf ball construction. As a result, a golf ball may be selected as being particularly suitable for a golfing environment on the basis of whether the golf ball's configurations of various golf ball construction aspects improves the trajectory component.

Methods for Selecting a Golf Ball Based on Environmental Factors

Figure 26:
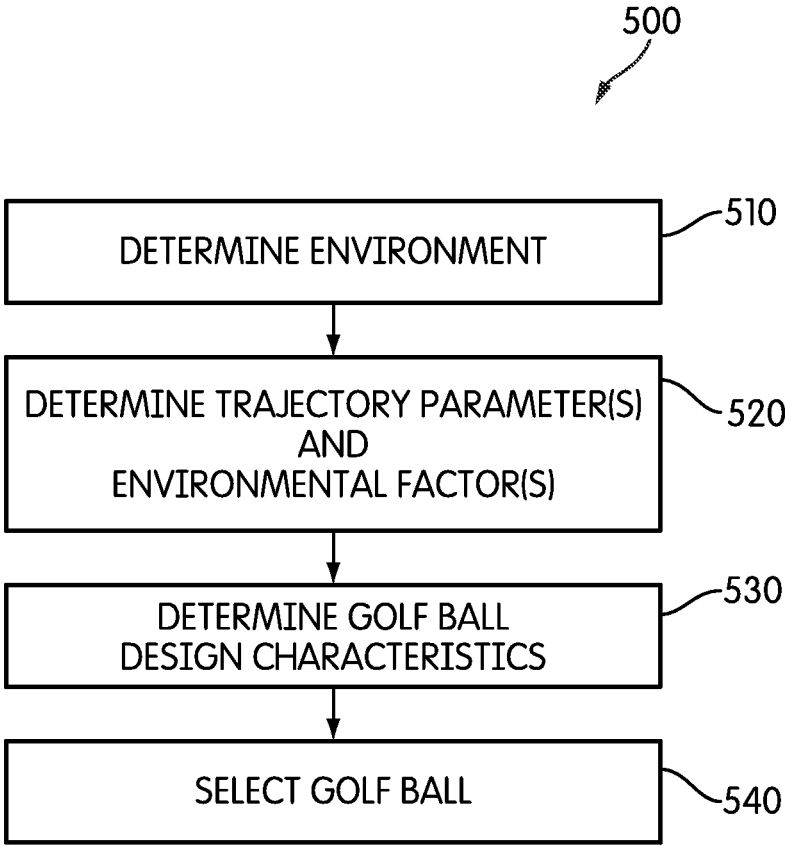
FIG. 26 is a flow diagram for an embodiment of a method for selecting a golf ball based on environmental factors.

A first method 500 for selecting a golf ball based on environmental factors is depicted in FIG. 26. Method 500 includes steps 510, 520, 530, and 540. In step 510, a golfing environment is indicated. The golfing environment may be similar to first golfing environment 20 or second golfing environment 30, for example, or any golf course or other location at which golf may be played. The golfing environment may be indicated by name, such as by the country, state, county, city, or any other similar governmental designator. Alternatively, the golfing environment may be indicated by a geographic location, such as by use of a longitude and a latitude.

Then, in step 520, one or more environmental factors corresponding with the golfing environment is established. Such environmental factors may be predominant environmental factors of the golfing environment. That is, such factors may have a particularly dominant impact upon one or more trajectory components of golf balls that are hit in the golfing environment. Depending upon the golfing environment, such factors may include an altitude; a grass type; a green speed; a moisture content; a wind speed; a temperature; or a visible landscape characteristic, such as a color. Additionally, in some embodiments, particular values for the one or more environmental factors may be obtained from real-time weather condition or forecast information, or from properties associated with a particular golf course.

In addition, one or more trajectory components that depend upon the environmental factor may be ascertained. The trajectory components may be particularly sensitive to or critically affected by the environmental factors.

In step 530, one or more golf ball construction aspects are determined. The golf ball construction aspects may be particularly relevant to the trajectory components, or may have particular impact upon the trajectory components. Alternatively, the golf ball construction aspects may be particularly pertinent to the environmental factors.

In some cases, indoor test range (ITR) or simulation data may be obtained to generate a correlation between each of the various golf ball construction aspects and the effect or response to different environmental factors. For example, in some embodiments, a look-up table or chart containing relationships between environmental factors and specific golf ball construction aspects may be used to determine the effect of environmental factors on the different trajectory components or other performance characteristics of a golf ball. In other embodiments, an algorithm or program may be used to generate the relationships.

FIG. 27 is an example of a chart generated using test range or simulation data in order to determine a relationship between a golf ball construction aspect and an environmental factor. In this embodiment, the environmental factor may be an altitude or elevation, and the golf ball construction aspect may be a dimple pattern, including, but not limited to, various numbers, sizes, shapes, or dimensions of dimples. Trajectory simulations were performed at three different elevations or altitudes, for three golf balls including different dimple patterns, and under two different orientations (i.e., once under "pole" orientation, in which a pole centrally located between a seam of the golf ball is oriented to point up, and once under "seam" orientation, in which a point on the seam is oriented to point up). Those trajectories were simulated with respect to a range of launch angles and a range of ball back-spin values.

With respect to the environmental factor, the 1st elevation was a substantially low elevation, such as a sea-level elevation, the 3rd elevation was a substantially high elevation, such as in a high desert region, and the 2nd elevation was an elevation between the 1st elevation and the 3rd elevation. In addition, with respect to differences in golf ball construction aspects, ball 3 had a dimple depth of approximately 10 microns deeper than a dimple depth of ball 2, for example.

Based on the results of the simulations, the effect or response of the environmental factor, in this case altitude or elevation, may be determined for the various different golf ball dimple patterns. FIG. 27 depicts carry distances of the simulated trajectories for each orientation of the three golf balls and for each of the three different elevations. Each carry distance represents an average of the carry distances for a variety of combinations of launch angle and ball back-spin. Those carry distances are in turn averages of a range of individual carry distances at each launch angle and ball back-spin combination. Other charts or look-up tables may be similarly generated for other golf ball construction aspects and/or other environmental factors.

In step 540, a plurality of golf balls is identified, each golf ball having various configurations of the golf ball construction aspects. A selection criteria is also identified. Selection criteria may include any desired performance of a golf ball that is to be maximized or improved for the given environmental factor. In some cases, the selection criteria may be configured to select the particular golf ball construction aspect that maximizes or improves a particular trajectory component, such as carry distance or total distance, for a given environmental factor. In other cases, however, the selection criteria may be configured to maximize or improve another characteristic or property associated with the trajectory or flight path of the golf ball. Then, the golf ball whose golf ball construction aspects are configured to best satisfy the selection criteria is selected.

For example, in accordance with the chart depicted in FIG. 27, at the 1st elevation, ball 2 with a "seam" orientation has a longer carry distance than ball 3 with a "seam" orientation. In contrast, at the 3rd elevation, ball 3 with a "seam" orientation has a longer carry distance than ball 2 with a "seam" orientation. Accordingly, for an environmental factor associated with elevation (including air pressure), the dimple configuration associated with golf ball 2 under the "seam" orientation may be selected for elevations similar to the 1st elevation, while the dimple configuration associated with golf ball 3 under the "seam" orientation may be selected for elevations similar to the 3rd elevation.

In an exemplary embodiment of a method for selecting a golf ball based on environmental factors, with respect to second golfing environment 30, an altitude or barometric pressure may be established as a predominant environmental factor of the golfing environment. A carry distance or a total distance of a trajectory may then be ascertained as being particularly sensitive to or critically affected by altitude or barometric pressure. Subsequently, a dimple characteristic, which may be a dimple depth, may be determined to be pertinent to the carry distance or total distance. A plurality of golf balls may then be identified as well as a selection criteria, which may be satisfied by a deeper dimple. The golf ball of the plurality of golf balls having a deeper dimple may then be selected.

Alternate Embodiments

In a second exemplary embodiment of the method, a golfing environment is indicated for which a grass type is established as an environmental factor. Subsequently, golf ball construction aspects determined to be pertinent to grass type may include aspects that affect ball back-spin (such as a cover hardness, a moment of inertia, or a dimple depth) and aspects that affect carry distance or total distance (such as a number of layers of construction, or a physical characteristic or material of a core portion or layer).

In a third exemplary embodiment of the method, a golfing environment is indicated for which green speed (as measured by a stimpmeter, for example) is established as an environmental factor, and a roll distance may be ascertained as corresponding with green speed. Subsequently, golf ball construction aspects determined to be pertinent to green speed may include aspects that affect ball back-spin.

In a fourth exemplary embodiment of the method, a golfing environment is indicated for which moisture content is established as an environmental factor, and a roll distance may be ascertained as corresponding with moisture content. Subsequently, golf ball construction aspects determined to be pertinent to moisture content may include aspects that affect carry distance and aspects that affect ball back-spin.

In a fifth exemplary embodiment of the method, a golfing environment is indicated for which wind speed is established as an environmental factor, and trajectory height may be ascertained as corresponding with wind speed. Subsequently, golf ball construction aspects determined to be pertinent to wind speed may include aspects that affect ball back-spin and aspects that affect trajectory height.

In a sixth exemplary embodiment of the method, a golfing environment is indicated for which temperature is established as an environmental factor. Subsequently, golf ball construction aspects determined to be pertinent to temperature may include a compression deformation, or a coefficient of restitution.

In a seventh exemplary embodiment of the method, a golfing environment is indicated for which a visible landscape characteristic, such as a color of landscape, is established as an environmental factor. Subsequently, golf ball construction aspects determined to be pertinent to visible landscape characteristics may include a visible cover characteristic, such as color or indicia.

Selection criteria for a visible landscape characteristic may include a contrasting or opposing color to increase visibility of a golf ball. Accordingly, using a color wheel or other color theory mechanism to determine contrasting or opposing color, selection criteria may be configured to maximize or increase visibility of a golf ball against the predominant visible landscape characteristic. A visible cover characteristic, such as color or indicia, of the golf ball may be selected based on the visible landscape characteristic. For example, in a golfing environment where the visible landscape characteristic is associated with a predominant green color, a golf ball having a visible cover characteristic associated with a purple or violet hue may be selected. In another golfing environment where the visible landscape characteristic is associated with a predominant greenish-blue color, a golf ball having a visible cover characteristic associated with a red or orange hue may be selected.

In an eighth exemplary embodiment of the method, a golfing environment is indicated for which a course length or an average hole length is established as an environmental factor. Subsequently, golf ball construction aspects determined to be pertinent to course length may include aspects that affect carry distance and aspects that affect total distance.

In a ninth exemplary embodiment of the method, a golfing environment is indicated for which a course slope rating is established as an environmental factor. Subsequently, golf ball construction aspects determined to be pertinent to course slope rating may include aspects that affect ball back-spin.

In some embodiments, more than one golf ball construction aspect may be pertinent to an environmental factor. For example, in the fourth exemplary embodiment above, moisture content is established as an environmental factor for the golfing environment. Accordingly, both a golf ball construction aspect affecting carry distance, such as a dimple configuration, and a golf ball construction aspect affecting ball back-spin, such as a moment of inertia, may be determined to be pertinent to moisture content.

Figure 28:
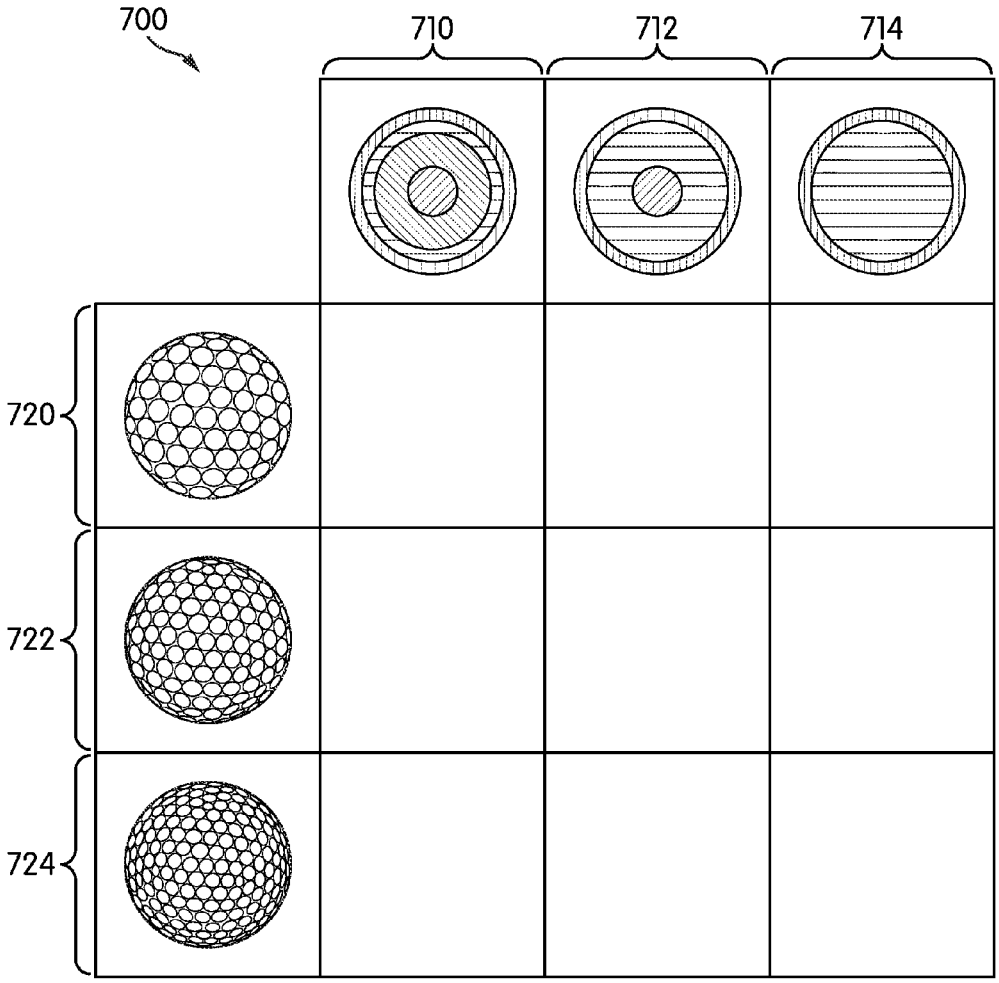
FIG. 28 is an embodiment of a range of golf ball designs.

FIG. 28 depicts a plurality of golf balls 700 that may be identified for selecting among in the fourth exemplary embodiment. Some of the golf balls 700 have a first configuration 710 of moment of inertia, some of the golf balls 700 have a second configuration 712 of moment of inertia, and some of the golf balls 700 have a third configuration 714 of moment of inertia. At the same time, some of the golf balls 700 have a first configuration 720 of dimple depth, some of the golf balls 700 have a second configuration 722 of dimple depth, and some of the golf balls 700 have a third configuration 724 of dimple depth.

In such embodiments, the selection criteria may be a combination of a subsidiary selection criteria based upon moment of inertia and a subsidiary selection criteria based upon dimple depth. For example, a selection criteria may include a weighted average of the two subsidiary selection criteria. Accordingly, the selection criteria may select one of golf balls 700 having configurations of the pertinent golf ball construction aspects based upon which golf ball construction aspects are perceived to be most critical.

In some golfing environments, trajectory components such as carry distance and total distance may be most pertinent. In other golfing environments, however, trajectory components such as roll distance may be more pertinent. As an example, although the golf swings in FIGS. 1-10 are depicted as being performed on first fairway 22 of first golfing environment 20 and second fairway 32 of second golfing environment 30, golf swings may be performed closer to the green.

Figure 29:
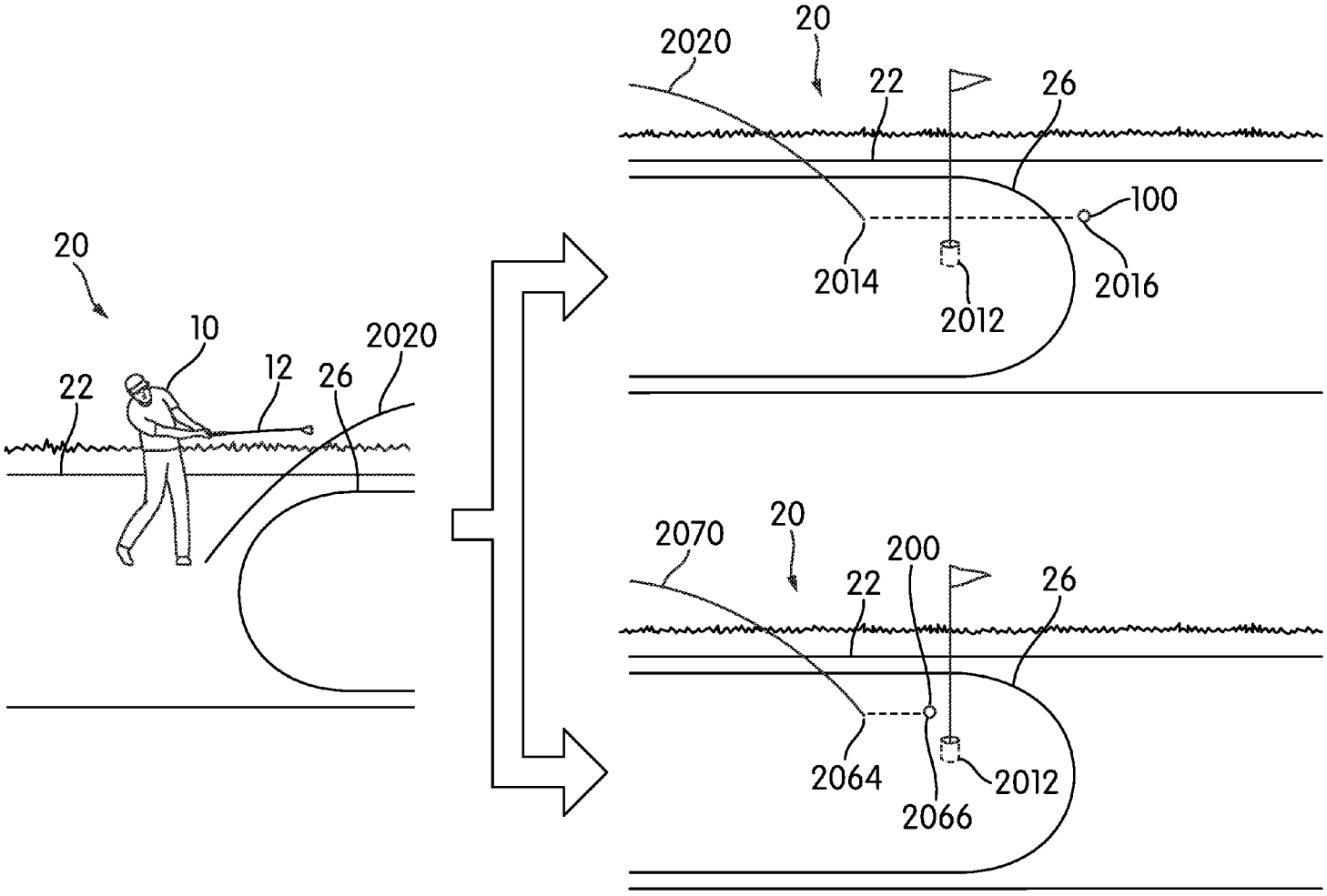
FIG. 29 is a side elevational view depicting portions of a fifth trajectory travelled by the first embodiment of a golf ball and portions of a sixth trajectory travelled by the second embodiment of the golf ball in a third golfing environment.

As depicted in FIG. 29, golfer 10 in first golfing environment 20 has swung at and struck first golf ball 100 toward target spot 2012 in a first swing using first golf club 12. Similarly, in an alternate second swing, golfer 10 in first golfing environment 20 has swung at and struck second golf ball 200 toward target spot 2012 using first golf club 2012. Since golfer 10 is relatively close to first green 26 and first target spot 2012, first golf club 12 is depicted as being a golf club suitable for hitting a golf club relatively short distances, such as a wedge.

Figure 30:
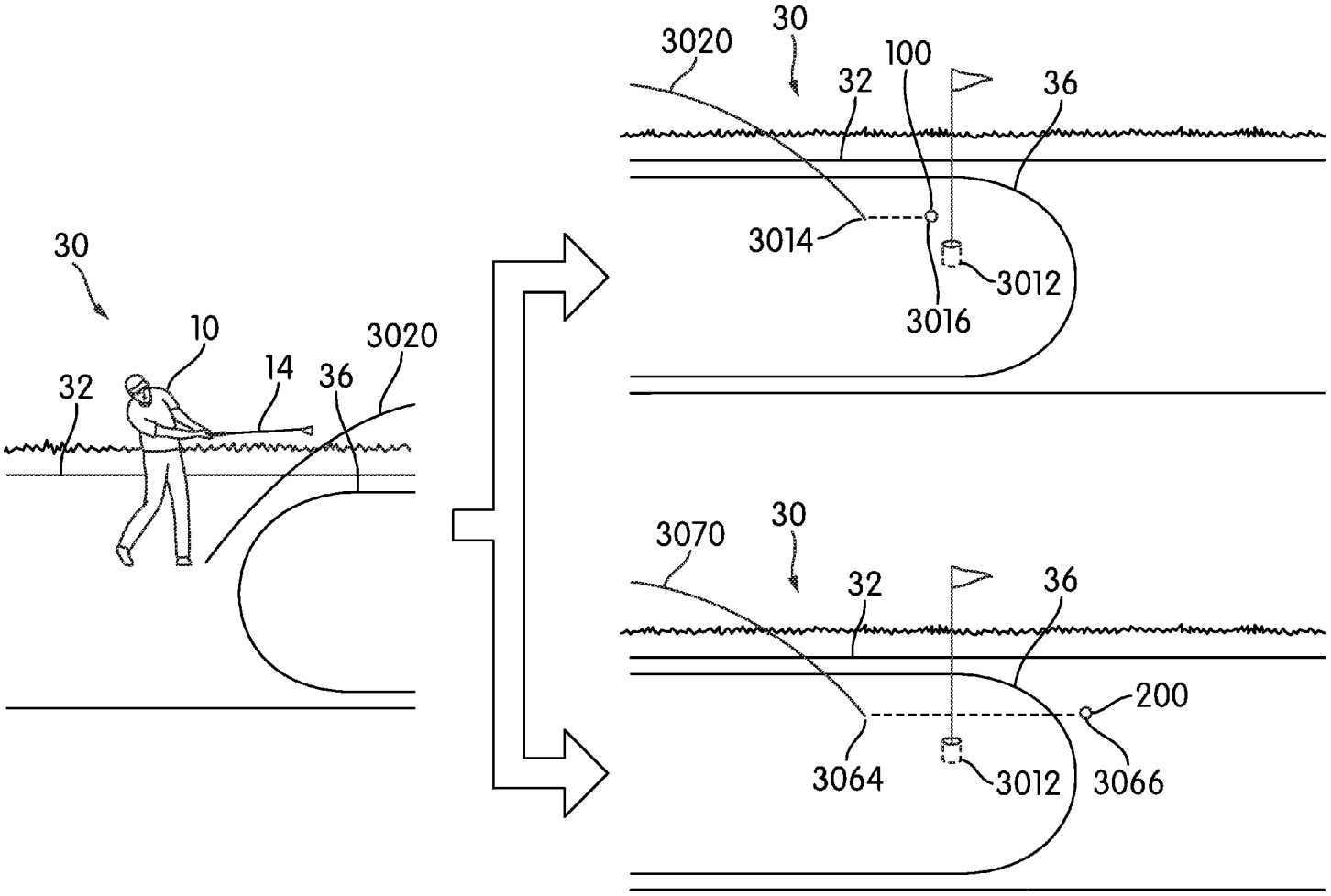
FIG. 30 is a side elevational view depicting portions of a seventh trajectory travelled by the first embodiment of the golf ball and portions of an eighth trajectory travelled by the second embodiment of the golf ball in a fourth golfing environment.

In contrast, in FIG. 30, golfer 10 in golfing environment 30 is depicted as having struck first golf ball 100 toward target spot 3012 in a third swing using second golf club 14. Alternatively, in an alternate fourth swing, golfer 10 in golfing environment 30 is depicted as having struck second golf ball 200 toward target spot 3012. As with FIG. 29, since golfer 10 is relatively close to second green 36, second golf club 14 is depicted as being a golf club suitable for hitting a golf club relatively short distances.

In FIG. 29, the distance between first contact spot 2014 and first stopping spot 2016 (corresponding with first golf ball 100) is greater than the distance between second contact spot 2064 and second stopping spot 2066 (corresponding with second golf ball 200). In contrast, in FIG. 30, the distance between third contact spot 3014 and third stopping spot 3016 (corresponding with first golf ball 100) is less than the distance between fourth contact spot 3064 and fourth stopping spot 3066 (corresponding with second golf ball 200).

In other words, with respect to roll distance, second golf ball 200 performs better given the same swing than first golf ball 100 in first golfing environment 20, and first golf ball 100 performs better given the same swing than second golf ball 200 in second golfing environment 30. The differences in performance between golf balls 100 and 200 may be attributable to differences in aspects of golf ball design construction.

In addition to the steps discussed above, some methods for selecting golf balls based on environmental factors may further incorporate golf swing parameter measurements associated with specific golfers. As depicted for example in FIG. 27, a second method 600 for selecting a golf ball based on environmental factors includes steps 610, 620, 630, 640, and 650. Steps 610, 620, and 630 may be substantially similar to steps 510, 520, and 530 of first method 500.

In step 640, however, one or more golf swing parameters having an interaction with the one or more golf ball construction aspects are specified, and a swing parameter value for a particular golfer (and even, perhaps, for a particular club) is obtained for each of the one or more golf swing parameters specified. Golf swing parameters may include club-related parameters such as a swing speed, a club path, and an attack angle. Golf swing parameters may also include ball-related parameters such as a ball speed, a ball spin, a ball spin slope, and a launch angle.

For example, simulation data similar to the simulation data of the chart in FIG. 27 may be generated, but instead of being averaged across the various combinations of launch angle and ball back-spin, the simulation data may be separated out by launch angle, by ball back-spin, or by both. Differences in carry distance at different elevations between golf balls having dimple patterns may in turn be broken down by launch angle and ball back-spin, too.

Figure 31:
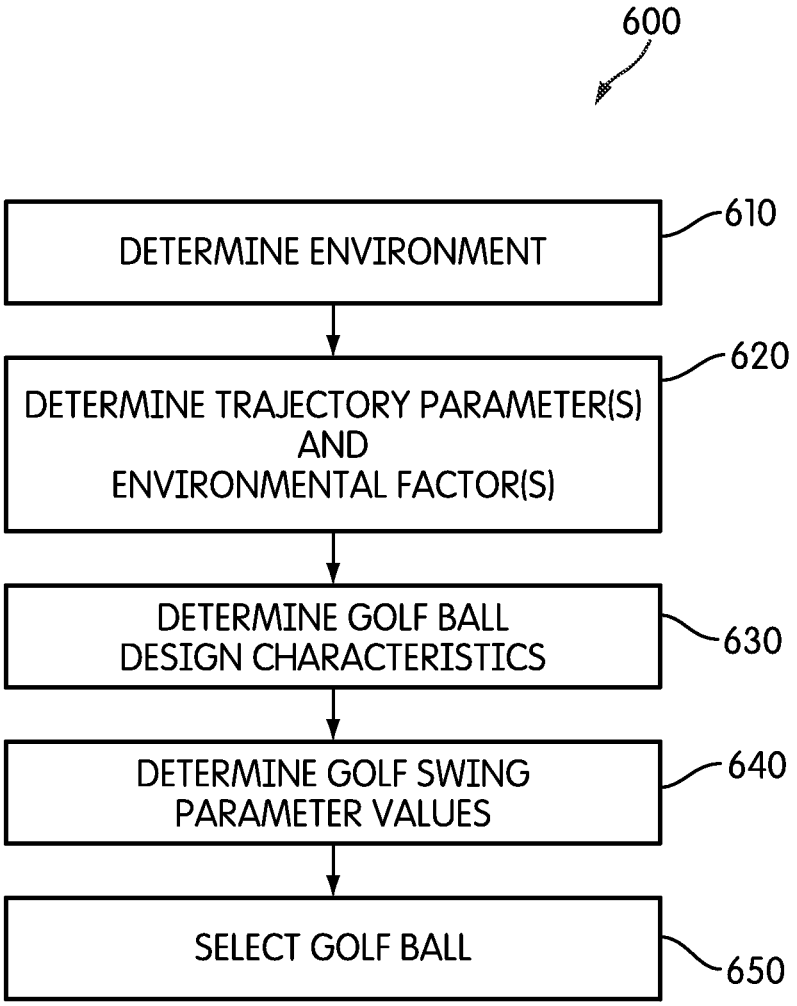
FIG. 31 is a flow diagram for another embodiment of a method for selecting a golf ball based on environmental factors.
Figure 32:
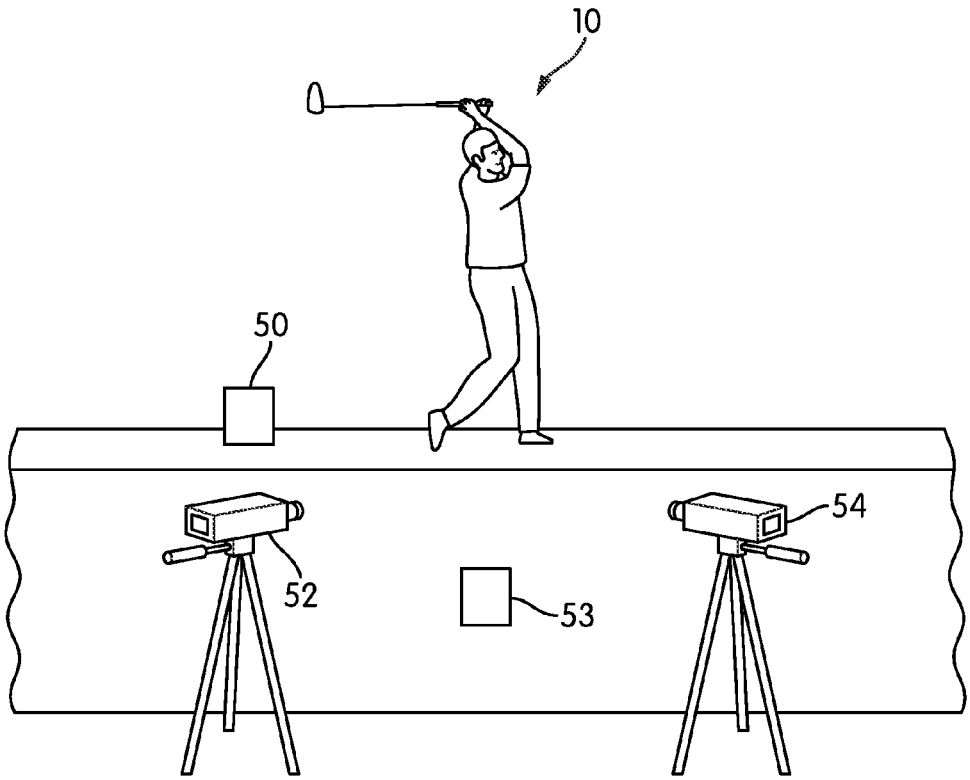
FIG. 32 is a side elevational view depicting an embodiment of a system for gathering golf swing parameter measurements.

FIG. 31 depicts a system for gathering measurements related to various golf swing parameters. The system includes measuring devices 50, 52, 53, and 54. First measuring device 50 is used to gather measurements related to a first golf swing parameter. More specifically, measurements of first measuring device 50 relate to the speed or velocity of the golf swing. Second measuring device 52 is used to gather measurements related to a second golf swing parameter. More particularly, measurements of second measuring device 52 relate to a spin of the golf ball, such as a backside spin. Third measuring device 53 is used to gather measurements related to a third golf swing parameter. More particularly, measurements of third measuring device 53 relate to the launch angle of a golf swing. Fourth measuring device 54 is used to gather measurements related to a fourth golf swing parameter. More particularly, measurements of fourth measuring device 54 relate to the attack angle of a golf swing.

Devices 50, 52, 53, and 54 may be any devices, such as photographic devices, launch monitors, sound monitors, or position-measuring devices, used to measure or otherwise capture information about various parameters associated with golf swings. For example, one or more of devices 50, 52, 53, and 54 may include a camera, a video camera, a light sensor, or another device measuring light. Additionally, one or more of devices 50, 52, 53, and 54 may include a radar device (e.g., doppler radar devices, devices that give information similar to doppler radar devices, and other radar devices), a sonar device, or another device measuring reflected energy. One or more of devices 50, 52, 53, and 54 may further include a receiving or transmitting device enabling intercommunication with a corresponding transmitting or receiving device, such as a device within a golf club or a golf ball. That is, in various configurations, devices 50, 52, 53, and 54 may include a variety of measurement equipment, sensing equipment, and communication equipment to allow devices 50, 52, 53, and 54 to obtain and communicate measurements related to golf swing parameters.

In step 650, a plurality of golf balls is identified, each golf ball having configurations of the various golf ball construction aspects, and a selection criteria is identified as well. The golf ball with golf ball construction aspects that best satisfies the selection criteria when combined with the swing parameter values is then selected.

For example, at a 1st elevation, a carry distance of one golf ball may be either greater than or less than a carry distance of another golf ball, depending upon the launch angle. Accordingly, for an environmental factor associated with elevation, a golf ball may be selected based upon the environmental factor as well as golf swing parameter values corresponding with swing parameter values such as launch angle.

CONCLUSION

While various embodiments of the invention have been described, the description is intended to be exemplary rather than limiting, and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method for selecting an optimal golf ball comprising steps of:
   (i) indicating a golfing environment;
   (ii) establishing at least one environmental factor corresponding with the golfing environment;
   (iii) determining, via an indoor test range or a simulation, one or more golf ball construction aspects pertinent to the at least one environmental factor, wherein the determining includes creating a lookup table or chart that expresses a trajectory component as a function of the one or more golf ball construction aspects and the at least one environmental factor;
   (iv) identifying (a) a plurality of golf balls, each golf ball of the plurality of golf balls having a different configuration of each of the one or more golf ball construction aspects, and (b) a selection criteria related to the trajectory component; and
   (v) selecting the optimal golf ball for play within the golfing environment from the plurality of golf balls, wherein the golf ball has the configuration of the one or more golf ball construction aspects that meets the selection criteria for the established at least one environmental factor.

2. The method of claim 1, wherein the at least one environmental factor is selected from a group consisting of an altitude and a barometric pressure.

3. The method of claim 1, wherein the one or more golf ball construction aspects include a dimple characteristic.

4. The method of claim 3, wherein the one or more golf ball construction aspects include a dimple depth.

5. The method of claim 4, wherein the selection criteria is met by a deeper dimple.

6. The method of claim 1, wherein the at least one environmental factor is selected from a group consisting of an altitude, a grass type, a green speed, a moisture content, a wind speed, a temperature, and a visible landscape characteristic.

7. The method of claim 1, wherein the one or more golf ball construction aspects are selected from a group consisting of a number of layers of construction, a physical characteristic of a layer, a material of a layer, a physical characteristic of a material of a layer, a moment of inertia, a compression deformation, a coefficient of restitution, a dimple characteristic, a dimple pattern, and a visible cover characteristic.

8. A method for selecting an optimal golf ball comprising steps of:

(i) indicating a golfing environment;

(ii) establishing at least one environmental factor corresponding with the golfing environment;

(iii) ascertaining a trajectory component dependent upon the at least one environmental factor, via an indoor test range or a simulation;

(iv) determining a golf ball construction aspect pertinent to the trajectory component, via the indoor test range or the simulation, wherein the determining includes creating a lookup table or chart that expresses the trajectory component as a function of the golf ball construction aspect and the at least one environmental factor;

(v) identifying (a) a plurality of golf balls, each golf ball of the plurality of golf balls having a different configuration of the golf ball construction aspect, and (b) a selection criteria related to the trajectory component; and (vi) selecting the optimal golf ball for play within the golfing environment from the plurality of golf balls, wherein the golf ball has the configuration of the one or more golf ball construction aspects that meets the selection criteria for the established at least one environmental factor.

9. The method of claim 8, wherein the at least one environmental factor is selected from a group consisting of an altitude and a barometric pressure.

10. The method of claim 8, wherein the trajectory component is selected from a group consisting of a carry distance and a total distance.

11. The method of claim 8, wherein the golf ball construction aspect is a dimple characteristic.

12. The method of claim 11, wherein the golf ball construction aspect is a dimple depth.

13. The method of claim 12, wherein the selection criteria is met by a deeper dimple.

14. The method of claim 8, wherein the at least one environmental factor is selected from a group consisting of an altitude, a grass type, a green speed, a moisture content, a wind speed, a temperature, and a visible landscape characteristic.

15. The method of claim 8, wherein the golf ball construction aspect is selected from a group consisting of a number of layers of construction, a physical characteristic of a layer, a material of a layer, a physical characteristic of a material of a layer, a moment of inertia, a compression deformation, a coefficient of restitution, a dimple characteristic, a dimple pattern, and a visible cover characteristic.

16. A method for selecting a golf ball for a golfer comprising steps of:

(i) indicating a golfing environment;

(ii) establishing at least one environmental factor corresponding with the golfing environment;

(iii) ascertaining a trajectory component dependent upon the at least one environmental factor, via an indoor test range or a simulation;

(iv) determining one or more golf ball construction aspects pertinent to the trajectory component, via the indoor test range or the simulation, wherein the determining includes creating a lookup table or chart that expresses the trajectory component as a function of the one or more golf ball construction aspects and the at least one environmental factor;

(v) obtaining one or more swing parameter values via a launch monitor or camera, the one or more swing parameter values corresponding respectively with one or more golf swing parameters of a golfer;

(vi) identifying (a) a plurality of golf balls, each golf ball of the plurality of golf balls having a configuration of the one or more golf ball construction aspects, and (b) a selection criteria related to the trajectory component;

(vi) selecting the golf ball of the plurality of golf balls having the configuration of the one or more golf ball construction aspects that best meets the selection criteria when combined with the one or more swing parameter values; and wherein the golf ball construction aspect is a dimple characteristic.

17. The method of claim 16, wherein the at least one environmental factor is selected from a group consisting of an altitude and a barometric pressure.

18. The method of claim 16, wherein the trajectory component is selected from a group consisting of a carry distance and a total distance.

19. The method of claim 16, wherein the golf ball construction aspect is a dimple depth.

20. The method of claim 19, wherein the selection criteria is met by a deeper dimple.

21. The method of claim 16, wherein the at least one environmental factor is selected from a group consisting of an altitude, a grass type, a green speed, a moisture content, a wind speed, a temperature, and a visible landscape characteristic.

22. The method of claim 16, wherein the one or more golf ball construction aspects are selected from a group consisting of a number of layers of construction, a physical characteristic of a layer, a material of a layer, a physical characteristic of a material of a layer, a moment of inertia, a compression deformation, a coefficient of restitution, a dimple characteristic, a dimple pattern, and a visible cover characteristic.

23. The method of claim 16, wherein the one or more golf swing parameters are selected from a group consisting of a swing speed, a club path, and an attack angle.

* * * * *